US008022969B2

(12) United States Patent
Elliott

(10) Patent No.: US 8,022,969 B2
(45) Date of Patent: Sep. 20, 2011

(54) ROTATABLE DISPLAY WITH SUB-PIXEL RENDERING

(75) Inventor: Candice Hellen Brown Elliott, Vallejo, CA (US)

(73) Assignee: Samsung Electronics Co., Ltd. (KR)

( * ) Notice: Subject to any disclaimer, the term of this patent is extended or adjusted under 35 U.S.C. 154(b) by 399 days.

(21) Appl. No.: 10/150,394

(22) Filed: May 17, 2002

(65) Prior Publication Data

US 2002/0186229 A1 Dec. 12, 2002

Related U.S. Application Data

(63) Continuation-in-part of application No. 10/051,612, filed on Jan. 16, 2002, now Pat. No. 7,123,277.

(60) Provisional application No. 60/290,086, filed on May 9, 2001, provisional application No. 60/290,087, filed on May 9, 2001, provisional application No. 60/290,143, filed on May 9, 2001, provisional application No. 60/313,054, filed on Aug. 16, 2001.

(51) Int. Cl.
*G09G 5/00* (2006.01)

(52) U.S. Cl. ..... 345/649; 345/659

(58) Field of Classification Search ..... 345/649, 345/656–659; 348/583
See application file for complete search history.

(56) References Cited

U.S. PATENT DOCUMENTS 3,971,065 A 7/1976 Bayer
4,353,062 A 10/1982 Lorteije et al.
4,593,978 A 6/1986 Mourey et al.
4,642,619 A 2/1987 Togashi
4,651,148 A 3/1987 Takeda et al.
4,751,535 A 6/1988 Myers
4,773,737 A 9/1988 Yokono et al.
4,786,964 A 11/1988 Plummer et al.
4,792,728 A 12/1988 Chang et al.
4,800,375 A 1/1989 Silverstein et al.
4,853,592 A 8/1989 Strathman
4,874,986 A 10/1989 Menn et al.
(Continued)

FOREIGN PATENT DOCUMENTS

DE 197 46 329 A1 3/1999
(Continued)

OTHER PUBLICATIONS

E-Reader Devices and Software, Jan. 1, 2001, Syllabus, http://www.campus-technology.com/article.asp?id=419.*

(Continued)

*Primary Examiner* — Jeffery A Brier
(74) *Attorney, Agent, or Firm* — Innovation Counsel LLP

(57) ABSTRACT

In a system comprising a processor, an image storage and a display, said display capable of displaying an image, and said image being renderable in a plurality of rotation degrees upon said display upon receipt of a command, a method of rotating an image, said image further comprising at least one member of a group, said group comprising text and images capable of being sub-pixel rendered, comprises the steps of: sub-pixel rendering said at least one member of a group; grouping said sub-pixels into a plurality of sub-pixel groups; rotating said plurality of sub-pixel groups such that each said sub-pixel group is rotated as a pixel on a pixel-to-pixel basis. In another embodiment, the display upon which rotation is performed comprises substantially equal subpixel rendering addressability limits in horizontal, vertical and diagonal directions.

14 Claims, 16 Drawing Sheets

U.S. PATENT DOCUMENTS 4,886,343 A 12/1989 Johnson
4,908,609 A 3/1990 Stroomer
4,920,409 A 4/1990 Yamagishi
4,965,565 A 10/1990 Noguchi
4,966,441 A 10/1990 Conner
4,967,264 A 10/1990 Parulski et al.
5,006,840 A 4/1991 Hamada et al.
5,052,785 A 10/1991 Takimoto et al.
5,113,274 A 5/1992 Takahashi et al.
5,132,674 A 7/1992 Bottorf
5,144,288 A 9/1992 Hamada et al.
5,184,114 A 2/1993 Brown
5,189,404 A 2/1993 Masimo et al.
5,233,385 A 8/1993 Sampsell
5,311,337 A 5/1994 McCartney, Jr.
5,315,418 A 5/1994 Sprague et al.
5,334,996 A 8/1994 Tanigaki et al.
5,341,153 A 8/1994 Benzschawel et al.
5,398,066 A 3/1995 Martinez-Uriegas et al.
5,436,747 A 7/1995 Suzuki
5,461,503 A 10/1995 Deffontaines et al.
5,485,293 A 1/1996 Robinder
5,535,028 A 7/1996 Bae et al.
5,541,653 A 7/1996 Peters et al.
5,561,460 A 10/1996 Katoh et al.
5,563,621 A 10/1996 Silsby
5,579,027 A 11/1996 Sakurai et al.
5,648,793 A 7/1997 Chen
5,754,163 A 5/1998 Kwon
5,754,226 A 5/1998 Yamada et al.
5,792,579 A 8/1998 Phillips
5,815,101 A 9/1998 Fonte
5,821,913 A 10/1998 Mamiya
5,899,550 A 5/1999 Masaki
5,917,556 A 6/1999 Katayama
5,949,496 A 9/1999 Kim
5,973,664 A 10/1999 Badger
6,002,446 A 12/1999 Eglit
6,008,868 A 12/1999 Silverbrook
6,034,666 A 3/2000 Kanai et al.
6,038,031 A 3/2000 Murphy
6,049,626 A 4/2000 Kim
6,061,533 A 5/2000 Kajiwara
6,064,363 A 5/2000 Kwon
6,097,367 A 8/2000 Kuriwaki et al.
6,108,122 A 8/2000 Ulrich et al.
6,144,352 A 11/2000 Matsuda et al.
6,160,535 A 12/2000 Park
6,184,903 B1 2/2001 Omori
6,188,385 B1 2/2001 Hill et al.
6,198,507 B1 3/2001 Ishigami
6,219,025 B1 4/2001 Hill et al.
6,225,967 B1 5/2001 Hebiguchi
6,225,973 B1 5/2001 Hill et al.
6,236,390 B1 5/2001 Hitchcock
6,239,783 B1 5/2001 Hill et al.
6,243,055 B1 6/2001 Fergason
6,243,070 B1 6/2001 Hill et al.
6,271,891 B1 8/2001 Ogawa et al.
6,278,434 B1 8/2001 Hill et al.
6,299,329 B1 10/2001 Mui et al.
6,326,981 B1 12/2001 Mori et al.
6,327,008 B1 12/2001 Fujiyoshi
6,339,426 B1 1/2002 Lui et al.
6,342,876 B1 1/2002 Kim
6,346,972 B1 2/2002 Kim
6,360,023 B1 3/2002 Betrisey et al.
6,377,262 B1 4/2002 Hitchcock et al.
6,392,717 B1 5/2002 Kunzman
6,393,145 B2 5/2002 Betrisey et al.
6,396,505 B1 5/2002 Lui et al.
6,441,867 B1 8/2002 Daly
6,453,067 B1 9/2002 Morgan et al.
6,466,618 B1 10/2002 Messing et al.
6,469,766 B2 10/2002 Waterman et al.
6,509,904 B1 1/2003 Lam
6,552,706 B1 4/2003 Ikeda et al.
6,624,828 B1 9/2003 Dresevic et al.
6,661,429 B1 12/2003 Phan
6,674,436 B1 1/2004 Dresevic et al.
6,681,053 B1 1/2004 Zhu
6,714,206 B1 3/2004 Martin et al.
6,738,526 B1 5/2004 Betrisey et al.
6,750,875 B1 6/2004 Keely, Jr. et al.
6,801,220 B2 10/2004 Greier et al.
6,804,407 B2 10/2004 Weldy
6,833,890 B2 12/2004 Hong et al.
6,836,300 B2 12/2004 Choo et al.
6,850,294 B2 2/2005 Roh et al.
6,856,704 B1 2/2005 Gallagher et al.
6,867,549 B2 3/2005 Cok et al.
6,885,380 B1 4/2005 Primerano et al.
6,888,604 B2 5/2005 Rho et al.
6,897,876 B2 5/2005 Murdoch et al.
7,230,667 B2 6/2007 Shin et al.
2001/0017515 A1 8/2001 Kusunoki et al.
2001/0040645 A1 11/2001 Yamazaki
2001/0048764 A1 12/2001 Betrisey et al.
2002/0012071 A1 1/2002 Sun
2002/0015110 A1 2/2002 Elliott
2002/0017645 A1 2/2002 Yamazaki et al.
2002/0093476 A1 7/2002 Hill et al.
2002/0122160 A1 9/2002 Kunzman
2002/0140831 A1 10/2002 Hayashi
2002/0149598 A1 10/2002 Greier et al.
2002/0190648 A1 12/2002 Bechtel et al.
2003/0011613 A1 1/2003 Booth, Jr.
2003/0034992 A1 2/2003 Brown Elliott et al.
2003/0043567 A1 3/2003 Hoelen et al.
2003/0048248 A1 3/2003 Fukumoto et al.
2003/0071826 A1 4/2003 Goertzen
2003/0071943 A1 4/2003 Choo et al.
2003/0077000 A1 4/2003 Blinn et al.
2003/0085906 A1 5/2003 Elliott et al.
2003/0103058 A1 6/2003 Elliott et al.
2003/0218618 A1 11/2003 Phan
2004/0008208 A1 1/2004 Dresevic et al.
2004/0021804 A1 2/2004 Hong et al.
2004/0061710 A1 4/2004 Messing et al.
2004/0085495 A1 5/2004 Roh et al.
2004/0095521 A1 5/2004 Song et al.
2004/0108818 A1 6/2004 Cok et al.
2004/0114046 A1 6/2004 Lee et al.
2004/0169807 A1 9/2004 Rho et al.
2004/0189662 A1 9/2004 Frisken et al.
2004/0189664 A1 9/2004 Frisken et al.
2004/0239813 A1 12/2004 Klompenhouwer
2004/0239837 A1 12/2004 Hong et al.
2004/0263528 A1 12/2004 Murdoch et al.
2005/0024380 A1 2/2005 Lin et al.
2005/0068477 A1 3/2005 Shin et al.
2005/0099426 A1 5/2005 Primerano et al.
2005/0140634 A1 6/2005 Takatori
2005/0151752 A1 7/2005 Phan

FOREIGN PATENT DOCUMENTS

DE 299 09 537 U1 10/1999
DE 199 23 527 11/2000
DE 199 23 527 A1 11/2000
DE 201 09 354 U1 9/2001
EP 0 158 366 A2 10/1985
EP 0 203 005 A1 11/1986
EP 0 322 106 A2 6/1989
EP 0 0671 650 9/1995
EP 0 793 214 A1 2/1996
EP 0 793 214 A1 9/1997
EP 0 812 114 A1 12/1997
EP 0 878 969 11/1998
EP 0 899 604 A2 3/1999
EP 899 604 A2 3/1999
EP 1 083 539 A2 3/2001
EP 1 261 014 A2 11/2002
GB 2 133 912 A 8/1984
GB 2 146 478 A 4/1985
JP 60-107022 6/1985
JP 02-000826 A 1/1990
JP 03-78390 4/1991

| | | | |
|---|---|---|---|
| JP | 03-036239 | B | 5/1991 |
| JP | 06-102503 | | 4/1994 |
| JP | 02-983027 | B2 | 11/1999 |
| JP | 2001203919 | | 7/2001 |
| JP | 2004-004822 | | 1/2004 |
| JP | 2004 078218 | | 3/2004 |
| WO | WO 97/23860 | | 7/1997 |
| WO | 97/44774 | A2 | 11/1997 |
| WO | WO 00/21067 | | 4/2000 |
| WO | WO 00/42564 | | 7/2000 |
| WO | WO 00/42762 | | 7/2000 |
| WO | WO 00/45365 | | 8/2000 |
| WO | WO 00/67196 | | 11/2000 |
| WO | WO 01/10112 | A2 | 2/2001 |
| WO | WO 01/29817 | A1 | 4/2001 |
| WO | WO 01/52546 | A2 | 7/2001 |
| WO | WO 02/059685 | A2 | 8/2002 |
| WO | WO 03/014819 | A1 | 2/2003 |
| WO | WO 03/050605 | A1 | 2/2003 |
| WO | WO 03/056383 | A1 | 7/2003 |
| WO | WO 2004/017129 | A1 | 2/2004 |
| WO | WO 2004/021323 | A2 | 3/2004 |
| WO | WO 2004/027503 | A1 | 4/2004 |

OTHER PUBLICATIONS

Jim Gettys and Keith Packard, The X Resize and Rotate Extension—RandR, 2001, Usenix Technical Conference 2001, pp. 1-9.*

Vincent Alzieu, LCD or CRT? That Is the Question, Jan. 14, 2002, Tom's Hardware Guide, http://www.tomshardware.com/reviews/comparison-15,409-3.html, pp. 1-3.*

Vincent Alzieu, Basics of LCD, Jan. 14, 2002, Tom's Hardware Guide, http://www.tomshardware.com/reviews/comparison-15,409-5.html, pp. 1-2.*

Krantz, John H. et al., "Color Matrix Display Image Quality: The Effects of Luminance and Spatial Sampling," *SID International Symposium, Digest of Technical Papers*, 1990, pp. 29-32.

Messing, Dean S. et al., "Improved Display Resolution of Subsampled Colour Images Using Subpixel Addressing," *Proc. Int. Conf. Image Processing* (*ICIP '02*), Rochester, N.Y., IEEE Signal Processing Society, 2002, vol. 1, pp. 625-628.

Messing, Dean S. et al., "Subpixel Rendering on Non-Striped Colour Matrix Displays," *International Conference on Image Processing*, Barcelona, Spain, Sep. 2003, 4 pages.

Lee, Baek-woon et al., "40.5L: Late-News Paper: TFT-LCD with RGBW Color System," *SID 03 Digest*, 2003, pp. 1212-1215.

"ClearType magnified," *Wired Magazine*, Nov. 8, 1999, Microsoft Typography, article posted Nov. 8, 1999, and last updated Jan. 27, 1999, © 1999 Microsoft Corporation, 1 page.

Credelle, Thomas L. et al., "P-00: MTF of High-Resolution PenTile Matrix™ Displays," *Eurodisplay 02 Digest*, 2002, pp. 1-4.

Daly, Scott, "Analysis of Subtriad Addressing Algorithms by Visual System Models," *SID Symp. Digest*, Jun. 2001, pp. 1200-1203.

Elliott, Candice H. Brown et al., "Color Subpixel Rendering Projectors and Flat Panel Displays," New Initiatives in Motion Imaging, SMPTE Advanced Motion Imaging Conference, Feb. 27-Mar. 1, 2003, Seattle, Washington, pp. 1-4.

Elliott, Candice H. Brown et al., "Co-optimization of Color AMLCD Subpixel Architecture and Rendering Algorithms," *SID Symp. Digest*, May 2002, pp. 172-175.

Feigenblatt, R.I., "Full-color imaging on amplitude-quantized color mosaic displays," *SPIE*, vol. 1075, Digital Image Processing Applications, 1989, pp. 199-204.

Johnston, Stuart J., "An Easy Read: Microsoft's Clear Type," *InformationWeek Online*, Redmond, WA, Nov. 23, 1998, 3 pages.

Johnston, Stuart J., "Clarifying ClearType," *InformationWeek Online*, Redmond, WA, Jan. 4, 1999, 4 pages.

"Just Outta Beta," *Wired Magazine*, Dec. 1999, Issue 7.12, 3 pages.

Klompenhouwer, Michiel A. et al., "Subpixel Image Scaling for Color Matrix Displays," *SID Symp. Digest*, May 2002, pp. 176-179.

Markoff, John, "Microsoft's Cleartype Sets Off Debate on Originality," *The New York Times*, Dec. 7, 1998, 5 pages.

"Microsoft ClearType," http://www.microsoft.com/opentype/cleartype, Sep. 26, 2002, 4 pages.

Platt, John C., "Optimal Filtering for Patterned Displays," Microsoft Research, *IEEE Signal Processing Letters*, 2000, 4 pages.

Platt, John, "Technical Overview of ClearType Filtering," Microsoft Research, http://research.microsoft.com/users/iplatt/cleartype/default.aspx, Sep. 17, 2002, 3 pages.

Poor, Alfred, "LCDs: The 800-pound Gorilla," *Information Display*, Sep. 2002, pp. 18-21.

"Ron Feigenblatt's remarks on Microsoft ClearType™," http://www.geocities.com/SiliconValley/Ridge/6664/ClearType.html, Dec. 5, 1998, Dec. 7, 1998, Dec. 12, 1999, Dec. 26, 1999, Dec. 30, 1999 and Jun. 19, 2000, 30 pages.

"Sub-Pixel Font Rendering Technology," © 2003 Gibson Research Corporation, Laguna Hills, CA, 2 pages.

Werner, Ken, "OLEDs, OLEDs, Everywhere . . . ," *Information Display*, Sep. 2002, pp. 12-15.

Adobe Systems, Inc., website, 2002, http://www.adobe.com/products/acrobat/cooltype.html.

Betrisey, C., et al., "Displaced Filtering for Patterned Displays," 2000, *Society for Information Display* (*SID*) *00 Digest*, pp. 296-299.

Carvajal, D., "Big Publishers Looking Into Digital Books," Apr. 3, 2000, *The New York Times*, Business/Financial Desk.

Elliott, C., "Active Matrix Display Layout Optimization for Subpixel Image Rendering," Sep. 2000, Proceedings of the 1st International Display Manufacturing Conference, pp. 185-189.

Elliott, C., "New Pixel Layout for PenTile Matrix," Jan. 2002, Proceedings of the International Display Manufacturing Conference, pp. 115-117.

Elliott, C., "Reducing Pixel Count without Reducing Image Quality," Dec. 1999, *Information Display*, vol. 15, pp. 22-25.

Gibson Research Corporation, website, "Sub-Pixel Font Rendering Technology, How It Works," 2002, http://www.grc.com/ctwhat.html.

Martin, R., et al., "Detectability of Reduced Blue Pixel Count in Projection Displays," May 1993, *Society for Information Display* (*SID*) *93 Digest*, pp. 606-609.

Microsoft Corporation, website, 2002, http://www.microsoft.com/reader/ppc/product/cleartype.html.

Microsoft Press Release, Nov. 15, 1998, Microsoft Research Announces Screen Display Breakthrough at COMDEX/Fall '98, PR Newswire.

Murch, M., "Visual Perception Basics," 1987, *SID*, Seminar 2, Tektronix, Inc., Beaverton, Oregon.

Okumura, H., et al., "A New Flicker-Reduction Drive Method for High-Resolution LCTVs," May 1991, *Society for Information Display* (*SID*) *International Symposium Digest of Technical Papers*, pp. 551-554.

Wandell, Brian A., Stanford University, "Fundamentals of Vision: Behavior, Neuroscience and Computation," Jun. 12, 1994, *Society for Information Display* (*SID*) *Short Course S-2*, Fairmont Hotel, San Jose, California.

Brown Elliott, C, "Co-Optimization of Color AMLCD Subpixel Architecture and Rendering Algorithms," SID 2002 Proceedings Paper, May 30, 2002 pp. 172-175.

Brown Elliott, C, "Development of the PenTile Matrix™ Color AMLCD Subpixel Architecture and Rendering Algorithms", SID 2003, Journal Article.

Brown Elliott, C, "New Pixel Layout for PenTile Matrix™ Architecture", IDMC 2002, pp. 115-117.

Brown Elliott, C, "Reducing Pixel Count Without Reducing Image Quality", Information Display Dec. 1999, vol. 1, pp. 22-25.

Krantz, John et al., Color Matrix Display Image Quality: The Effects of Luminance . . . SID 90 Digest, pp. 29-32.

Messing, Dean et al., Improved Display Resolution of Subsampled Colour Images Using Subpixel Addressing, IEEE ICIP 2002, vol. 1, pp. 625-628.

Messing, Dean et al., Subpixel Rendering on Non-Striped Colour Matrix Displays, 2003 International Conf on Image Processing, Sep. 2003, Barcelona, Spain, 4 pages.

Poor, Alfred, "LCDs: The 800-pound Gorilla," Information Display, Sep. 2002, pp. 18-21.

Wandell, Brian A., Stanford University, "Fundamentals of Vision: Behavior . . . ," Jun. 12, 1994, Society for Information Display (SID) Short Course S-2, Fairmont Hotel, San Jose, California.

USPTO, Non-Final Office Action dated, Feb. 7, 2005 in US Patent Publication No. 2003/0034992 (U.S. Appl. No. 10/051,612).
Clairvoyante Inc, Response to Non-Final Office, dated Jul. 7, 2005 in US Patent Publication No. 2003/0034992 (U.S. Appl. No. 10/051,612).
USPTO, Final Office Action dated, Aug. 31, 2005 in US Patent Publication No. 2003/0034992 (U.S. Appl. No. 10/051,612).
Clairvoyante Inc, Response to Final Office, dated Sep. 19, 2005 in U.S. Appl. No. 10/051,612 (U.S. Appl. No. 10/051,612).
USPTO, Non-Final Office Action dated, Dec. 15, 2005 in US Patent Publication No. 2003/0034992 (U.S. Appl. No. 10/051,612).
Clairvoyante Inc, Response to Non-Final Office, dated Feb. 8, 2006 in U.S. Appl. No. 10/051,612 (U.S. Appl. No. 10/051,612).
USPTO, Notice of Allowance, dated May 4, 2006 in U.S. Appl. No. 10/051,612 (U.S. Appl. No. 10/051,612).
USPTO, Non-Final Office Action, dated Jun. 27, 2005 in US Patent Publication No. 2003/0103058, (U.S. Appl. No. 10/150,355).
Clairvoyante Inc, Response to Non-Final Office Action, dated Dec. 22, 2005 in US Patent Publication No. 2003/0103058, (U.S. Appl. No. 10/150,355).
USPTO, Final Office Action, dated Mar. 7, 2006 in US Patent Publication No. 2003/0103058, (U.S. Appl. No. 10/150,355).
USPTO, Non-Final Office Action, dated Mar. 24, 2005 in US Patent Publication No. 2003/0085906, (U.S. Appl. No. 10/215,843).
Clairvoyante Inc, Response to Non-Final Office Action, dated Sep. 26, 2005 in US Patent Publication No. 2003/0085906, (U.S. Appl. No. 10/215,843).
USPTO, Final Office Action, dated Jan. 25, 2006 in US Patent Publication No. 2003/0085906, (U.S. Appl. No. 10/215,843).
Felici, James, "ClearType, CoolType: The Eyes Have It," The Seybold Report on Internet Publishing, vol. 4, No. 8, Apr. 2000, available at http://www.syboldreports.com/SRIP/free/0408/cooltype.html.
Dipert, Brian, "Display technology's results are compelling, but legacy is un'clear'," EDN Magazine, Oct. 26, 2000, pp. 63-72.
"Getting Started with the Adobe Acrobat eBook Reader," Adobe Systems Incoprorated, 2001.
Berry, John D., "Fuzzy Fonts," *Print*, May 2000 vol. 54, Issue 3, p. 38.
Taiwan Patent Office, Official Notification circa May 2007 in TW Patent Application No. 092113337.
PCT International Search Report dated Jun. 3, 2002 for PCT/US02/12610 (U.S. Appl. No. 10/051,612).
PCT International Search Report dated Dec. 9, 2003 for PCT/US03/15283 (U.S. Appl. No. 10/150,394).
PCT International Search Report dated Sep. 30, 2003 for PCT/US02/24994 (U.S. Appl. No. 10/215,843).
Clairvoyante Inc, Response to Non-Final Office Action, dated Jul. 25, 2006 in US Patent Publication No. 2003/0103058, (U.S. Appl. No. 10/150,355).
USPTO, Notice of Allowance, dated Nov. 30, 2006 in US Patent Publication No. 2003/0103058, (U.S. Appl. No. 10/150,355).
Clairvoyante Inc, Response to Non-Final Office Action, dated Jun. 26, 2006 in US Patent No. 7,184,066 (U.S. Appl. No. 10/215,843).
USPTO, Notice of Allowance, dated Jul. 16, 2006 in US Patent No. 7,184,066 (U.S. Appl. No. 10/215,843).
Summons to Oral Proceedings, EP Application No. 04754603.1, Nov. 10, 2010, 8 pages.

* cited by examiner

ROTATABLE DISPLAY WITH SUB-PIXEL RENDERING

RELATED APPLICATIONS

This application is a continuation-in-part and claims priority to U.S. patent application Ser. No. 10/051,612 ("the '612 application"), filed on Jan. 16, 2002, now published as U.S. Patent Application Publication No. 2003/0034992, and now issued as U.S. Pat. No. 7,123,277, entitled "CONVERSION OF A SUB-PIXEL FORMAT DATA TO ANOTHER SUB-PIXEL DATA FORMAT," which is hereby expressly incorporated herein by reference. U.S. patent application Ser. No. 10/051,612 claims priority to U.S. Provisional Patent Application No. 60/290,086, entitled "CONVERSION OF RGB PIXEL FORMAT DATA TO PENTILE MATRIX SUB-PIXEL DATA FORMAT," filed on May 9, 2001; U.S. Provisional Patent Application No. 60/290,087, entitled "CALCULATING FILTER KERNEL VALUES FOR DIFFERENT SCALED MODES," filed on May 9, 2001; U.S. Provisional Patent Application No. 60/290,143, entitled "SCALING SUB-PIXEL RENDERING ON PENTILE MATRIX," filed on May 9, 2001; and U.S. Provisional Patent Application No. 60/313,054, entitled "RGB STRIPE SUB-PIXEL RENDERING DETECTION," filed on Aug. 16, 2001, which are all hereby expressly incorporated herein by reference.

FIELD OF INVENTION

The invention pertains to the field of computer displays. More specifically, this invention pertains to rotation of color sub-pixelated displays using sub-pixel rendering.

BACKGROUND

Computer displays typically are constructed in a manner to display text and other video information in a landscape mode. There have been, of course, some displays that are constructed to display video data in portrait mode. To bridge the gap between the two modes of displays, some have built software drivers to enable a display to be rotated between landscape and portrait mode (i.e. typically 90, 180, or 270 degrees) and then to hit a software switch (either automatically or under user-controlled input) in order to render the image "right-side up". Badger, in U.S. Pat. No. 5,973,664, describes such a prior software system that enables the mapping of pixel information from one mode to the other—and hence, enables a rotatable display for desired user control.

Badger describes his system succinctly in FIGS. 1, 2 and 3. FIG. 1 illustrates the modification of an image before it is sent to a rotated computer display. Computer display 100A is oriented in standard landscape mode, displaying an image which is taller than it is wide. The space on either side of the image is wasted. The user of rotatable display 100A can rotate it 90 degrees clockwise, which would result in computer display 100B. The image on display 100B appears rotated 90 degrees, however, because of the rotation of the display. In order to view the image upright as on rotated display 100C, the computer compensates for the clockwise rotation of the display by sending to the display an image which is rotated 90 degrees in the counterclockwise direction. The image sent by the computer to display 100C would look like that on display 100D if the display were left in the standard landscape orientation.

An illustrative embodiment of Badger's system is shown in FIG. 2. Computer display 216 exhibits image 218 based on display image information 210 stored in display memory 212, which is accessible by computer 220. This display memory 212 is organized into arrays of memory cells, and the organization of information in display memory 212 takes the form of contiguous blocks of memory which each represent a single horizontal line of pixels on the display. Video hardware 214 uses display image information 210 in display memory 212 to generate display signals for computer display 216. The appearance of image 218 on computer display 216 is determined by the organization of information 210 placed in display memory 212. When software application 200, such as a word processor or a drawing program, needs to put an image 204 on display screen 216, it typically places image information 204 in source memory 202. Application 200 then signals operating system 206 that image 204 in source memory 202 needs to be put on display screen 216. Operating system 206 then communicates this information to driver 208. Driver 208 is a small software program which performs the task of retrieving source image information 204 from source memory 202 and putting it into display memory 212. If any modifications to the orientation of image 204 are necessary, driver 208 performs these modifications while writing display image information 210 to display memory 212. Driver 208 performs all modifications to image 204 using a single parameterized method of operation that can be used to rotate image 204 for any of a number of orientation modes.

Referring now to FIG. 3, image 210 to be shown on computer display 216 is in the form of an array of display image lines 306, with each display image line 306 being an array of pixels 308. Driver 208 transfers image 204 line by line, pixel by pixel from source memory 202 to display memory 212. Computer display 216 shows what is in display memory 212, and driver 208 can change the orientation of displayed image 218 by changing the ordering of pixels 308 of image 210 in display memory 212. In FIG. 3, an image of an arrow is shown in source memory 202. Display memory 212 contains an image of the same arrow rotated counterclockwise 90 degrees. The mapping of pixels 304 from source memory 202 to display memory 212 is illustrated by the three pixels marked A, B, and C, which are mapped to the three pixels 308 marked A', B', and C'.

When a user wishes to change the orientation of images 218 on computer display 216, the user makes a selection of one of a variety of possible orientation modes. When this selection occurs, driver 208 is notified, and a setup procedure begins so that images 218 later drawn to computer display 216 will have the desired orientation. This setup procedure involves using information about the desired orientation to calculate two increment parameters, X.sub.—Increment and Y.sub.—Increment. The X.sub.—Increment parameter indicates the difference in display memory 212 between pixels 308 which correspond to adjacent pixels 304 of the same source image line 302 in source memory 202. For example, pixels A and B are adjacent pixels 304 of the same source image line 302 in FIG. 3. For display image 210, the values of these two pixels 304 are transferred to A' and B' in display memory 212. The difference in memory addresses between A' and B' in display memory 212 is the X.sub.—Increment parameter. The Y.sub.—Increment parameter is the difference in display memory 212 between pixels 308 which correspond to adjacent pixels 304 of different source image lines 302 in source memory 202. For display image 210, pixels A' and C' correspond to pixels A and C of source memory 202, A and C being adjacent pixels 304 of different source image lines 302 in source memory 202. The difference in memory addresses between A' and C' in display memory 212 is the Y.sub.—Increment parameter.

When driver 208 is notified that image 204 is to be displayed on computer display 216, driver 208 invokes a set of software instructions to transfer image information 204 from source memory 202 into display memory 212 using the X.sub.—Increment and Y.sub.—Increment parameters, which are modified depending on the desired orientation mode. As each pixel 304 in a source image line 302 is transferred from source memory 202 to display memory 212, driver 208 determines the new pixel 308 location in display memory 212 by adding the X.sub.—Increment parameter to the location of the previous pixel 308 from that source image line 302. Each time a new source image line 302 is begun, the Y.sub.—Increment parameter is added to the location in display memory 212 of the first pixel 308 of the previous source image line 302. After the location in display memory 212 of the first pixel is determined, the location in display memory 212 of each subsequent pixel can be determined from the two increment parameters. In this way, the same set of instructions can effect the transfer of image information 204 regardless of which orientation mode selected, merely by changing the values of the X.sub.—Increment and Y.sub.—Increment parameters according to the selected orientation mode.

As useful as the Badger's system is (as depicted in FIGS. 1, 2 and 3) and while it is clearly desirable to have such user-flexibility in a display, the main limitation to the system disclosed by Badger is that the mapping takes places at the pixel-level—and no finer level of mapping is described. Today's displays are taking advantage of sub-pixel rendering—methods and apparatus that allow for a finer resolution of video data (in particular, text). In fact, both Microsoft and Adobe have methods that allow for sub-pixel rendering using the traditional RGB stripe.

Part of the problem is that prior art displays (particularly those relying on the RGB stripe) suffer from a non-rotationally symmetrical Nyquist limit, addressability, and/or MTF response curve. When images are rotated on a display that is non-symmetrical, the direction that has the least performance limits the image quality as the image component requiring greater performance passes through that angle.

For example, many, if not most, western text (Latin & Cyrillic) have more high spatial frequency components in the horizontal than the vertical direction. These high spatial frequencies are spread over a range of frequencies and phases. On a display with fixed square pixels, only certain high spatial frequencies and phases can be displayed. On a prior art RGB Stripe panel, display sub-pixel rendering offers higher addressability, thus allowing higher spatial frequencies to have a greater range of phases, but only in the direction normal to the stripes. Thus fonts are best rendered using sub-pixel rendering with the stripes aligned vertically, in line with the majority of long strokes of most of the characters. Displays conventionally meet this requirement when the lines of text are aligned horizontally along the long axis of typical flat panel displays in the so called "landscape" orientation. But when the lines of text are aligned with the short axis, and the display physically rotated to the so called "portrait" orientation, desired to allow display of full pages of text, as they are usually printed on paper in the "portrait" orientation, the stripes are normal to the long strokes. Since sub-pixel rendering only increases the addressability normal to the stripes, the conventionally oriented striped panel is suboptimal for use in sub-pixel rendering text in the portrait orientation, as the text requires greater addressability in the 'wrong' axis.

For this reason, the stripes should be aligned vertically in portrait mode. This requires that the display be designated for use as a portrait display only. But many displays would benefit from the ability to be used in both modes. Many advantageous uses would abound—e.g. a flat panel monitor on a support that allows the user to rotate the display between portrait orientation for word processing and landscape orientation for other work; a so-called "tablet computer" or "Personal Digital Assistant" ("PDA") that allows the user to read an electronically stored book in portrait orientation and turn it to view it in landscape orientation to view a calendar. Thus, it is highly desirable to have a display that allows equal sub-pixel rendering performance in both portrait and landscape orientations.

For some uses of flat panels, images are rotated at any or even all angles. One such use is for navigation aids in automobiles and handheld devices such as Geo Positioning System (GPS) enabled map displays. As the car or user changes orientation with respect to the terrain, the map rotates in the counter direction on the display to keep the relative orientation of the displayed map image aligned with the terrain. On prior art displays, such as the RGB Stripe display, conventional whole pixel rendering allows higher spatial frequencies in the diagonal directions. Images that are rotated on the display change quality depending on whether the high spatial frequencies are in alignment with the diagonals or not. Thus, an image, such as a map, seems to shift in appearance (and, potentially, usability) as the image is rotated. Thus, it is highly desirable to have a display that has equal performance in any and all orientations. That is to say, its Nyquist Limit, addressability, and/or MTF response curves are equal in all directions. If these response functions were plotted for such a display, they would from a circle with the center at zero spatial frequency—as will be discussed in greater detail below.

The family of display architectures—disclosed in the commonly owned U.S. patent application Ser. No. 09/916,232, published as U.S. Patent Application Publication No. 2002/0015110 A1, and, now issued as U.S. Pat. No. 6,903,754, to Candice Hellen Brown Elliott, entitled "ARRANGEMENT OF COLOR PIXELS FOR FULL COLOR IMAGING DEVICES WITH SIMPLIFIED ADDRESSING," and known under the trademark name PENTILE™—all share the common trait of a red and green sub-pixel checkerboard upon which luminance information is mapped using sub-pixel rendering. When these displays sub-pixel render images that are rotated about, the image quality and appearance remains substantially constant due to the symmetrical nature of the red and green sub-pixel checkerboard layout and the filter response of the sub-pixel rendering algorithms. If the Nyquist Limit, addressability, and/or MTF response curves are plotted for these display architectures, it is found that they are circles with the center at zero spatial frequency.

Since a display with a circular response has equal performance in all direction, it follows that it must also have equal performance in landscape and portrait orientations.

In addition to the problems mentioned above regarding the quality of text when sub-pixel rendered on said RGB Stripe displays, another problem occurs when the prior art RGB stripe sub-pixel rendering methods are followed by a pixel-to-pixel rotational mapping, such as e.g. taught by Badger. Typically, as is often attempted in commercial use, the sub-pixel rendering of text is performed by the operating system, and the screen image rotation and/or mirror performed by a 'driver' afterwards. The problem arises when the text rendering code assumes that the sub-pixel stripes are aligned normal to the line of text (aligned with the tall stems of Western fonts). The sub-pixel rendered data is then remapped, improperly, by the screen rotation method such as taught by Badger, which has as an internal assumption, that the data is conventional, non-sub-pixel rendered data. That is to say that each red, green, and blue data point per pixel represent a color sample that is coincident. In sub-pixel rendered data, this assumption is false. When rotated by the Badger method, the sub-pixel rendering is "scrambled".

SUMMARY

One present embodiment is a method to modify the prior art RGB stripe sub-pixel rendering methods such that the assumption is that the screen to be used in portrait orientation, with the stripes running horizontally in this orientation, obtaining feedback from the parameters taught in Badger. This will allow the text rendering code to use a set of displaced filters that match the conditions of the parameters.

One present embodiment pre-sub-pixel renders the desired text, one character at time, that is to be rotated and/or mirrored to the orientation indicated by the selected parameters by a pixel to pixel rotational mapping scheme. Then each character bit map may be rotated by the pixel to pixel rotational mapping, such as taught by Badger, or any other suitable method, but in the converse (inverse) manner, before being stored as a bit map. If such a character were plotted to the graphics memory plane to its selected position, it would appear to be scrambled. When the entire image is rotated by the Badger, or other suitable method, the sub-pixel rendering is "unscrambled" back to its intended, useful alignment.

Another embodiment is to write sub-pixel rendered data for text, as well as all graphics, at the desired rotational orientation.

Yet another embodiment is to perform the rotation of conventional, high resolution images before sub-pixel rendering. Conventional data is drawn to the graphic memory plane. Using the Badger, or other suitable methods, the image is rotated and/or mirrored. Then the data is filtered and sub-pixel rendered. The display to which the data is sub-pixel rendered and displayed onto may be an RGB stripe, delta triad, Bayer, PENTILE™, or any other suitable sub-pixelated type display. If the display is a PENTILE™ display (as depicted in U.S. patent application Ser. No. 09/916,232, published as U.S. Patent Application Publication No. 2002/0015110, now issued as U.S. Pat. No. 6,903,754), the sub-pixel rendering may be the method described in the related '612 patent application as herein incorporated by reference.

Other features and advantages of the present invention will be apparent from the following detailed description.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the figures.

DETAILED DESCRIPTION

Reference will now be made in detail to implementations and embodiments of the present invention as illustrated in the accompanying drawings. Wherever possible, the same reference numbers will be used throughout the drawings and the following description to refer to the same or like parts.

Figure 4:
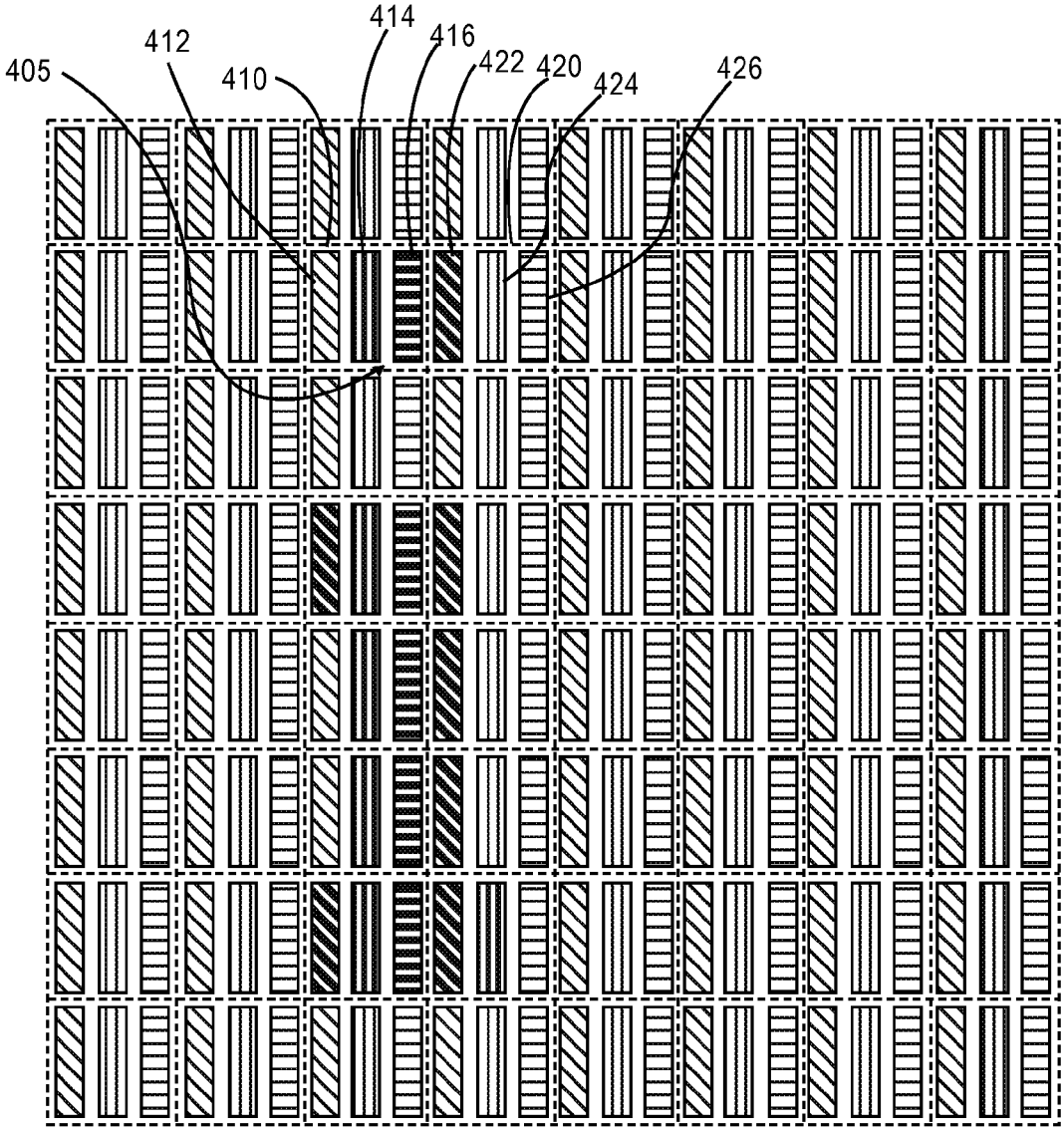
FIG. 4 (PRIOR ART)
FIG. 4 is an illustration of prior art sub-pixel rendering of a text character on an RGB stripe display.

FIG. 4 shows an exemplary text character—"i", in this case—sub-pixel rendered by a suitable prior art method for an RGB Stripe. As shown, this represents black text on a white background. It should be noted that the sub-pixels attempt to shape, or reconstruct, an idealized character—it is an approximation due to the limitations of the number of sub-pixels available. It should also be noted that the 'dot' 405 of the "i" overlaps the traditional boundaries of the conventional non-sub-pixel rendered fixed pixel definition—as shown by the dashed line boundaries 410 and 420. The red sub-pixel 422 and the green 414 and blue 416 sub-pixels form a new "logical pixel" that is shifted and lying across the two original pixels 410 and 420. Thus, the original, conventional pixel 410 when stored, would appear to be red—as only the red sub-pixel 412 is turned on. The conventional pixel 420, when stored, would be appear to be cyan—as only the green 424 and blue 426 sub-pixels are turned on.

Figure 5:
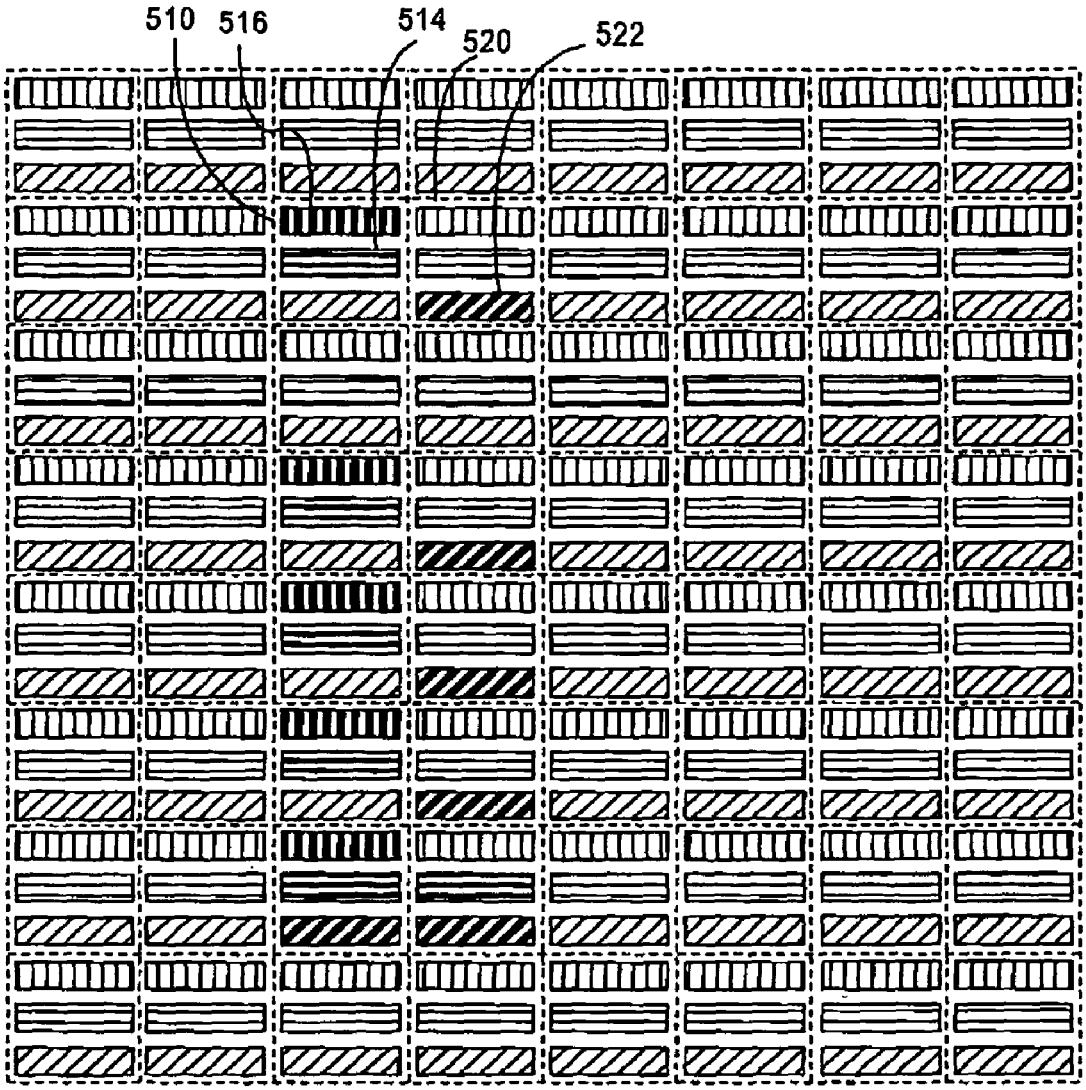
FIG. 5 (PRIOR ART)
FIG. 5 is an illustration of the results of rotating the image of FIG. 4 using a prior art method.

When the display of FIG. 4 is rotated counter clockwise and the image of the text is rotated clockwise to keep the character upright (as in a manner taught by the Badger or some other similar method), the same two values, red and cyan are applied to corresponding conventional pixels 510 and 520—as shown in FIG. 5 respectively. However, as the sub-pixel stripes are turned counter clockwise, the sub-pixels that formerly made up the 'dot' no longer line up to make a logical pixel. Thus, this method of rotating the image fails to maintain sub-pixel rendering utility.

Figure 6:
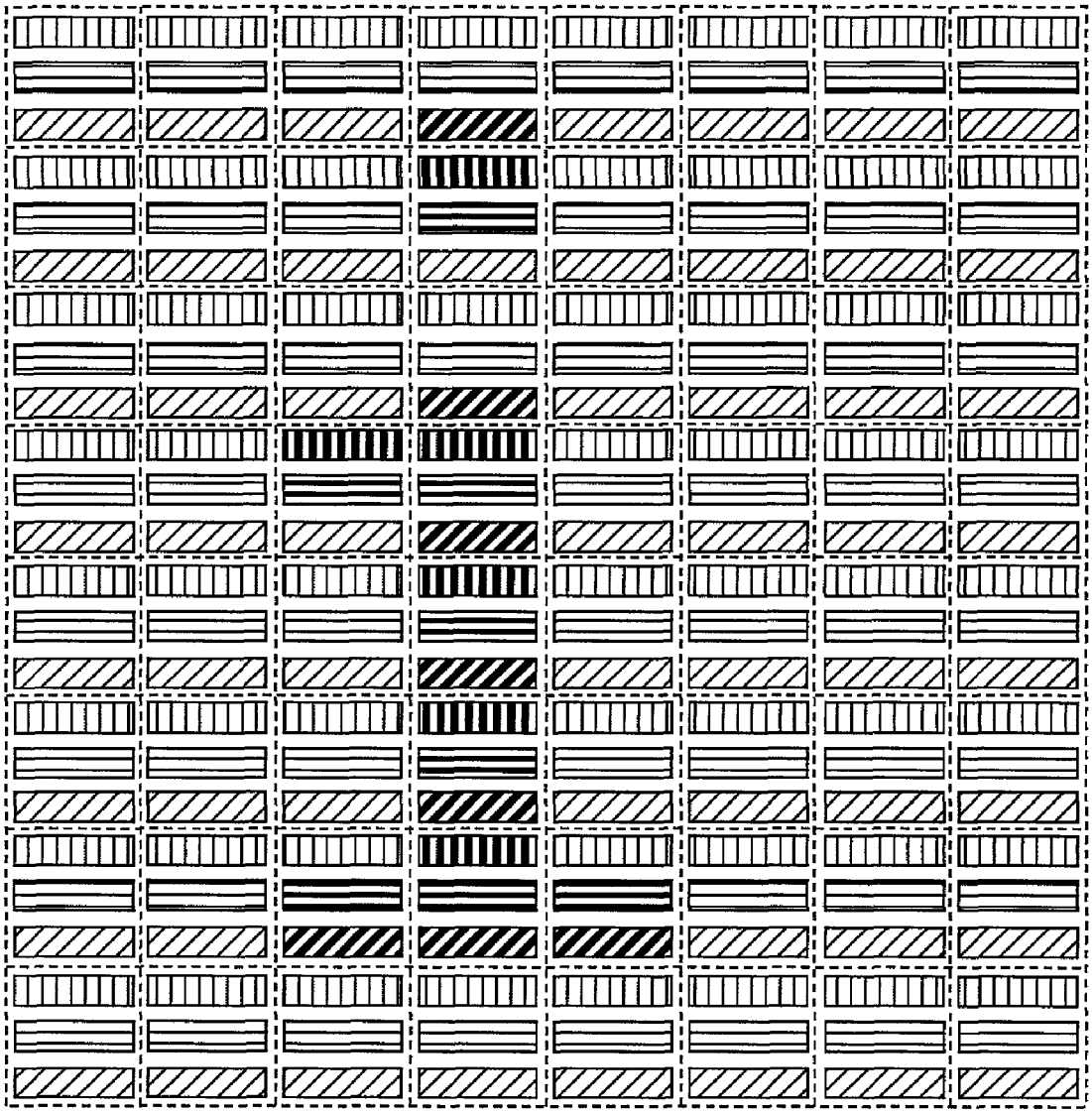
FIG. 6 is an illustration of the desired results of rotating the image of FIG. 4 using the present invention.

Referring now to FIG. 6, the text "i" character is shown when it is sub-pixel rendered correctly on a counter clockwise rotated display. It should be noted that the sub-pixels attempt to reconstruct an idealized character is only an approximation due to the limitations of the number of sub-pixels available. It should also be noted that its appearance is significantly different than that of FIG. 4, due to the sub-pixel architecture and its resulting Nyquist Limit, MTF, and addressability. FIG. 6 shows the desired image after rotation.

Figure 1:
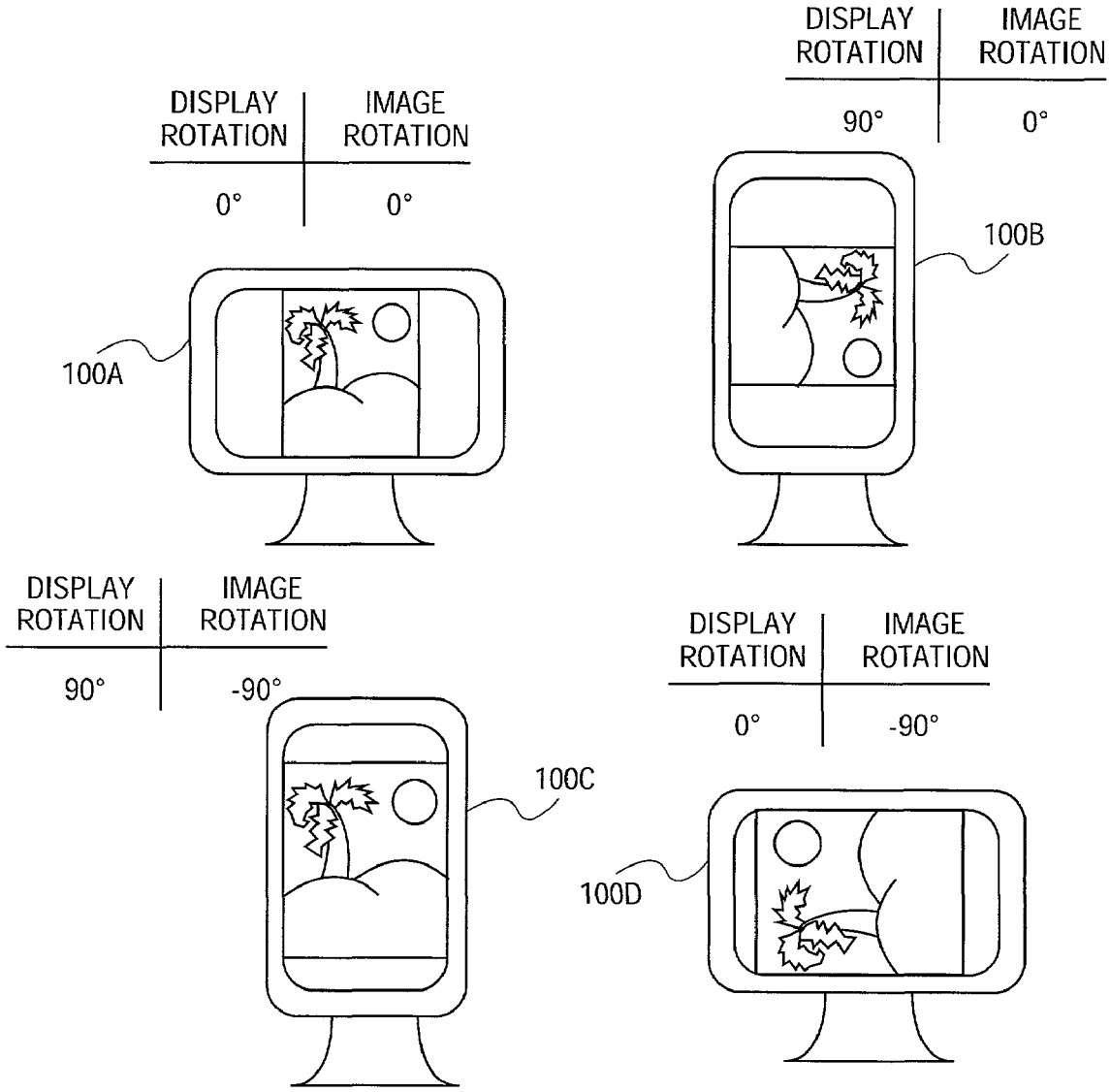
FIG. 1 (PRIOR ART)
FIG. 1 depicts various display and image orientations that are enabled with a prior art pixel to pixel rotational mapping scheme.
Figure 2:
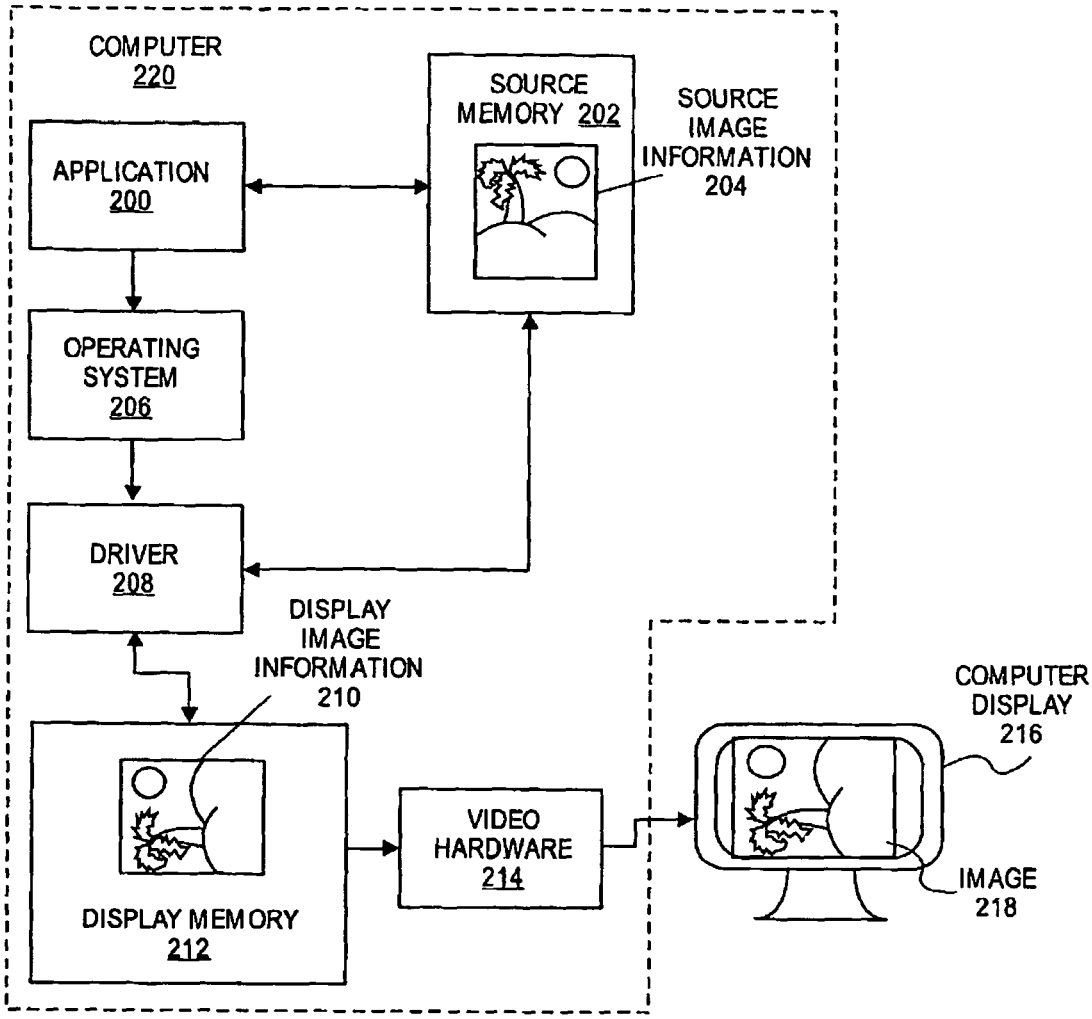
FIG. 2 (PRIOR ART)
FIG. 2 shows an embodiment of a prior art computer system that implements a pixel to pixel rotational mapping scheme as taught by Badger.
Figure 3:
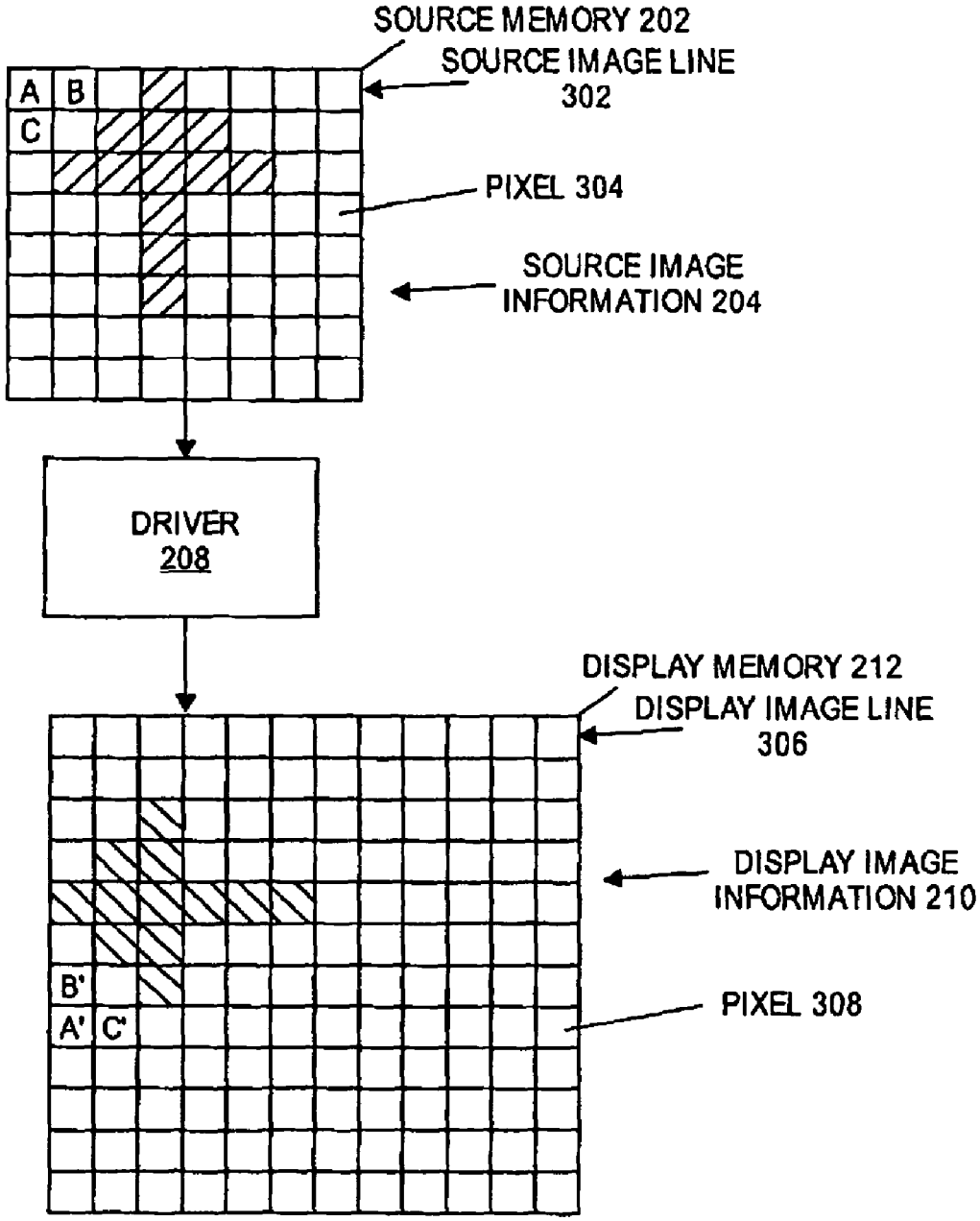
FIG. 3 (PRIOR ART)
FIG. 3 illustrates the relation of source memory to display memory in the system taught by Badger.
Figure 7:
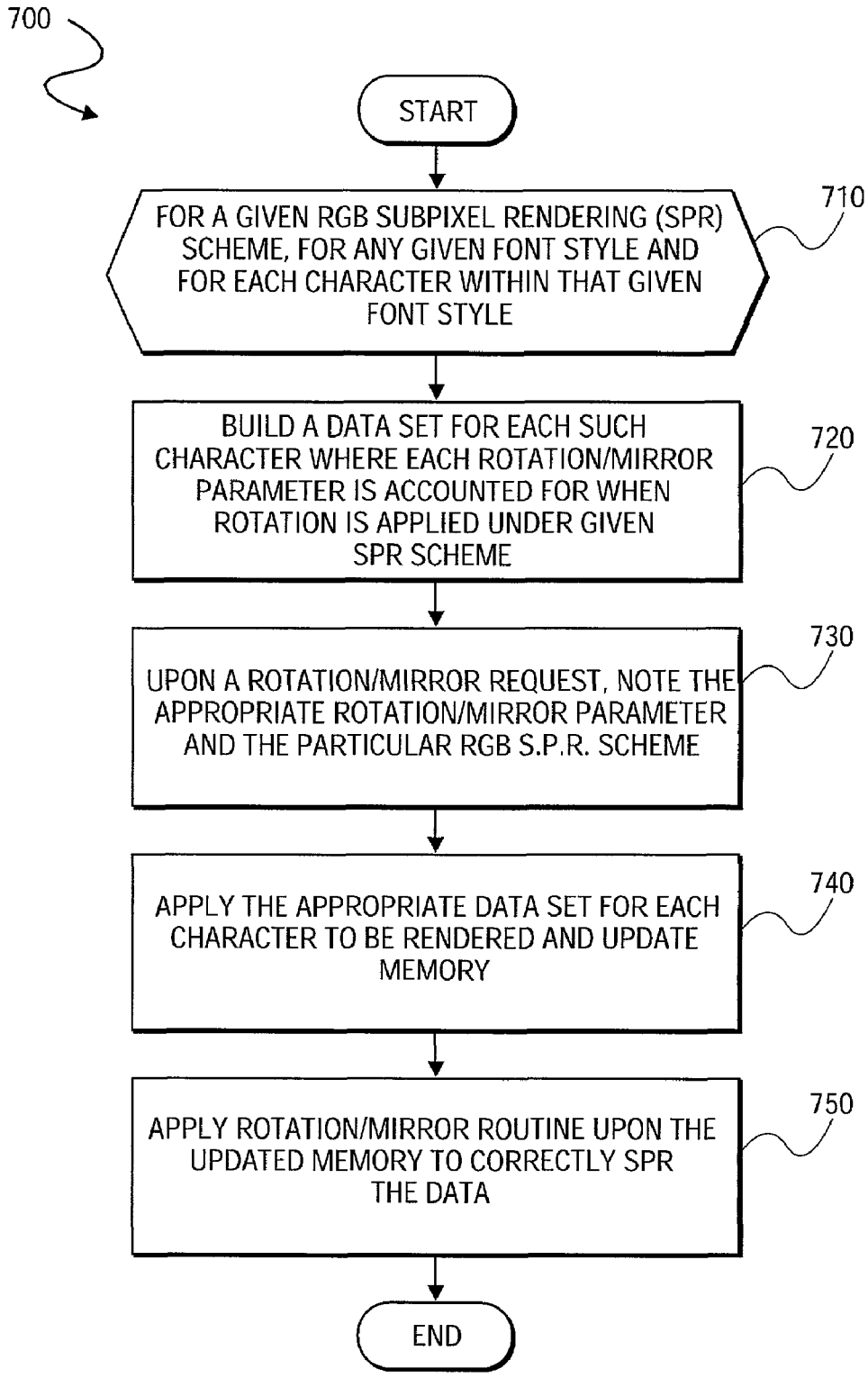
FIG. 7 is one embodiment of a method as practiced in accordance with the present invention.

One embodiment for achieving this according to the present invention is presented in FIG. 7. Method 700 starts at step 710, by noting a number of different RGB sub-pixel rendering (SPR) schemes, font styles and the characters within such font style needs to be dealt with appropriately. A data set is built at step 720 for each such character for a given font style and a given SPR scheme whereby the data set takes into account the various rotation/mirror parameters to be requested. It will be appreciated that such a data set could be pre-processed and stored in memory somewhere with a computer system, such as shown in FIG. 2. Alternatively, the data set in question could be built in real time a rotation/mirror request is made based upon the system knowledge of the font style and given RGB SPR scheme being applied.

Figure 8:
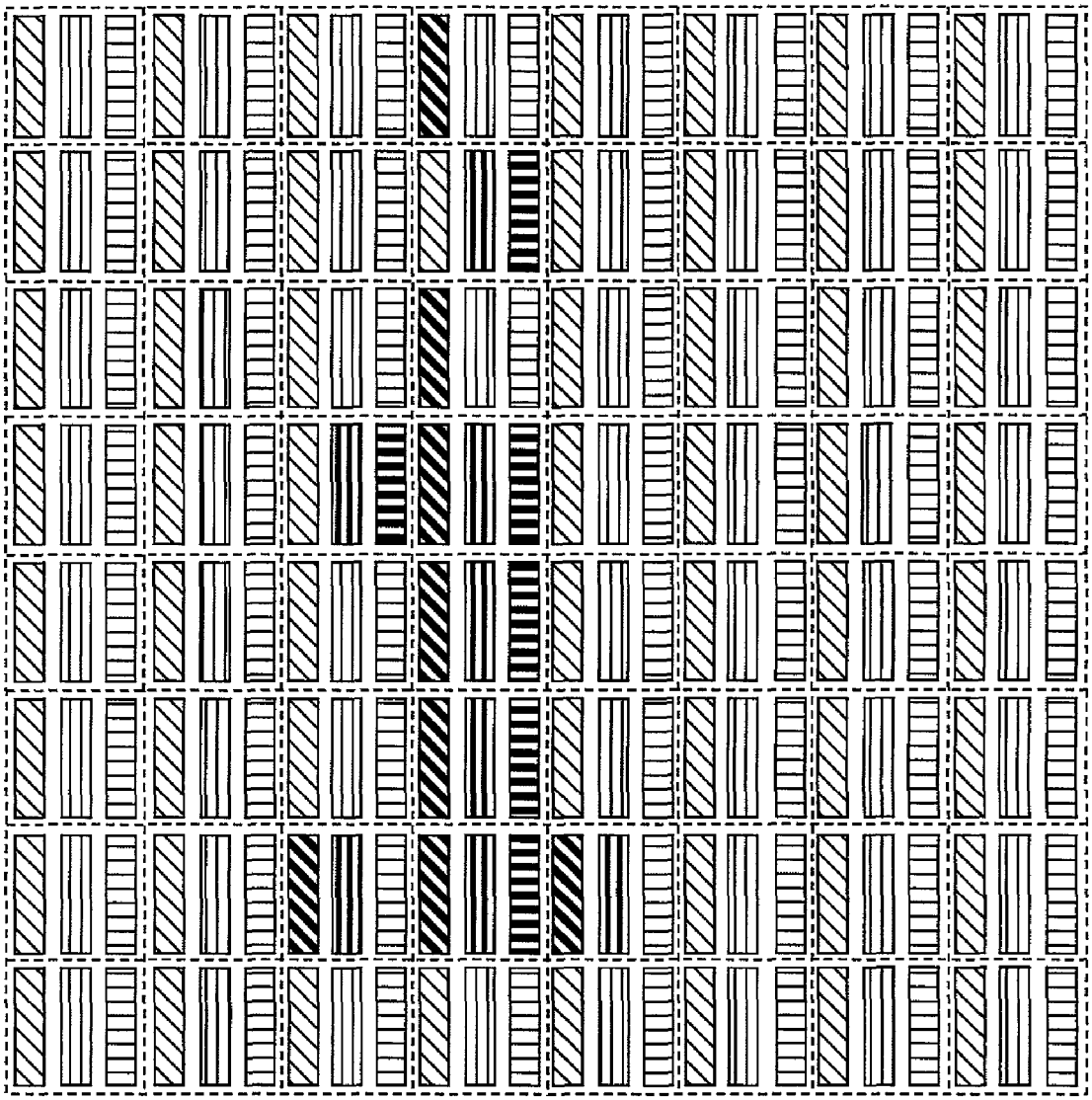
FIG. 8 is an illustration of a manner of storing and rendering the image of FIG. 6 prior to rotating the image according to the present invention.

FIG. 8 is a pictorial example of just such a data set for the character "i" when the particular RGB stripe of FIG. 8 is given an instruction to rotate screen counter-clockwise and the data to be viewed in "right-side" up in portrait mode. Referring back to FIG. 7, at step 730, upon a rotation/mirror request, the system has knowledge of the appropriate rotation/mirror parameters and the particular RGB SPR scheme. Of course, this system knowledge could reside in and be accessed by many different parts of the system. For example, the knowledge could be resident in the application that is having the data rendered in the first instance. Alternatively, it could reside in the operating system or even the driver parts of the system. It should be noted that method 700 can have any number of variations to achieve the same result.

At step 740, the appropriate data set is applied on a character-by-character basis and the memory for the image is updated accordingly. It should be appreciated that data sets could be applied on other than a character-by character basis. In fact, groups of characters could constitute a separate data set and, for non-text images, similar grouping of data sets according to image information could be similarly constructed and applied. Additionally, the memory of the image to be rotated/mirrored could reside in various parts of the computer system.

At step 750, the requested rotation/mirror command is applied to the updated memory image—which correctly renders the image according to the rotation/mirror command and the particular SPR scheme present. It will be appreciated that the steps of the present embodiment are not necessarily to be performed in the order described and that the present invention contemplates all obvious variations of the above embodiment.

Another embodiment of this method is to note the rotation and/or mirror parameters of the rotation method (e.g., by Badger, or some other similar method) to know what orientation the display sub-pixels will be. Then, a suitable method of sub-pixel rendering is applied, such as various displaced filter methods taught in the prior art or in the '612 application to pre-sub-pixel-render each character in the type font set. The image may then be rotated with the converse (inverse or reverse) operation to that to be later performed by the Badger method, or some other similar and suitable method, then the result may be stored as bit maps or as another memory scheme. The result of this converse (inverse or reverse) operation on the image then produces the desired result. When called upon by an application, such as a word processor, the image could then be plotted to the desired location in the graphic memory plane, where it is remapped/rotated by the Badger, or other similar method.

Reviewing the appearance difference of the sub-pixel rendered character "i" in FIGS. 4 and 6, the reason the appearance difference exists is that the RGB stripe display architecture is asymmetric, giving rise to an asymmetric addressability. The addressability is greater in a direction normal to the orientation of the stripes.

Figure 9:
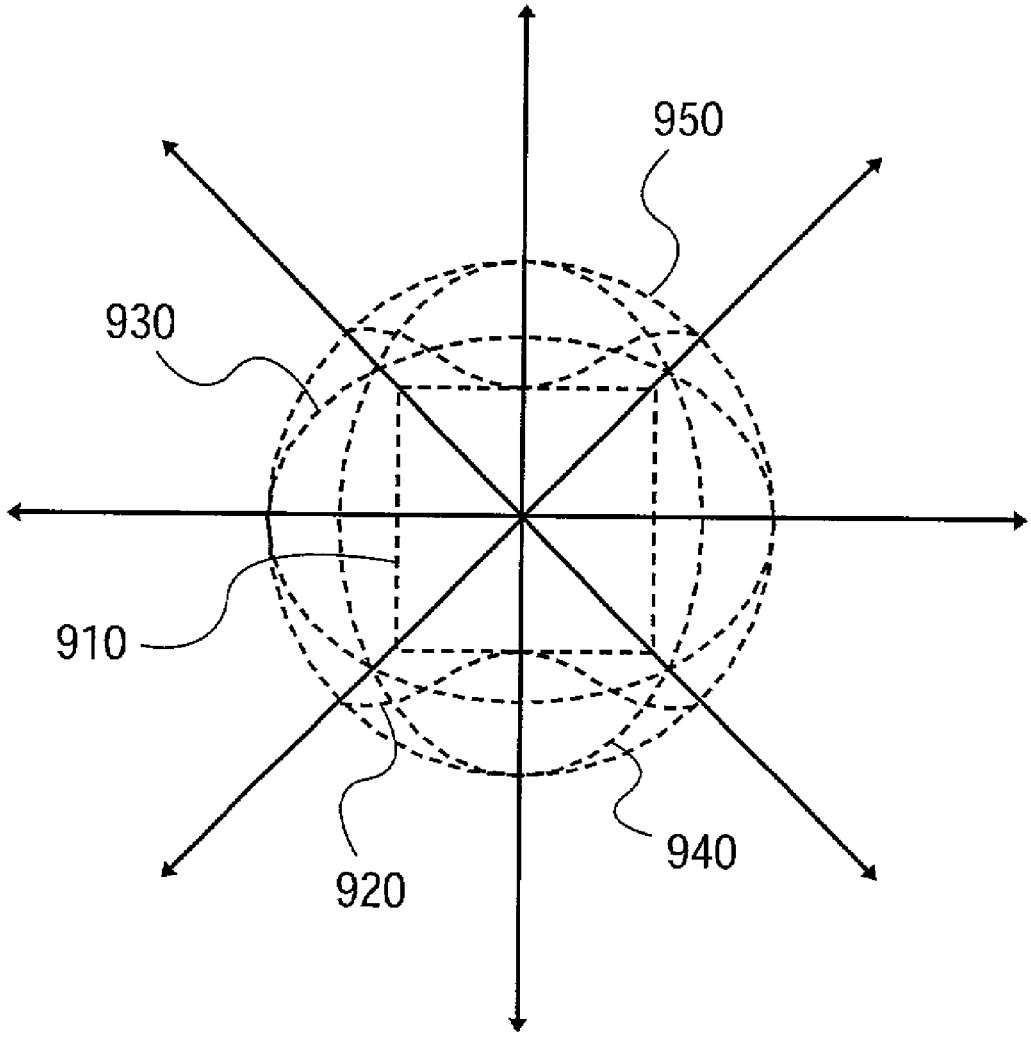
FIG. 9 is diagram comparing the Nyquist and addressability limits of RGB stripe and PENTILE™ displays to the relative addressability requirements of western type fonts.

FIG. 9 compares the Nyquist limit and the addressability of RGB stripe and PENTILE™ displays to each other and to the addressability requirements of typical western font type (Latin and Cyrillic). The origin, the intersection of the four axial lines, represents zero spatial frequency. The graph space around it represents spatial frequencies to be displayed on the panel in the orientation as depicted. Thus, horizontal spatial frequencies are represented along the horizontal axis line, vertical spatial frequencies along the vertical axis line, and so on. The convention followed here is that the RGB stripe display response is plotted for stripes in the vertical orientation, while the PENTILE™ display's blue stripes are similarly oriented.

In FIG. 9, the Nyquist limit 910 of the RGB stripe display is shown in dashed lines. It should be noted that it forms a square in the spatial frequency space—and that it has equal limits in the horizontal and vertical axis; but has a higher limit for diagonal spatial frequencies. Without sub-pixel rendering, the Nyquist limit 910 and addressability limit 910 are the same. The Nyquist limit 910 is the same for both non-sub-pixel rendered and sub-pixel rendered images.

The sub-pixel rendering addressability limit 920 of the RGB stripe is shown. It should be noted that it has twice the addressability (since only the red and green sub-pixels substantially participate in addressability improvement using sub-pixel rendering in the horizontal than in the vertical axis. When western text lines are horizontally orientated (that is, running normal to the stripes), its relative addressability requirement 930 is plotted. This curve forms an ellipse. In this orientation, the relative addressability requirement 930 is aligned optimally with the RGB stripe addressability limit 920. The increase in addressability with sub-pixel rendering is responsible for the increase in perceived text quality over non-sub-pixel rendering.

The relative addressability requirement of western text that is vertically oriented (that is, running in-line with the stripes) plotted in 940. In this orientation, the relative addressability requirement 940 is aligned in the least optimal orientation with the RGB stripe addressability limit 920. There is still some increase in perceived text quality due to sub-pixel rendering over non-sub-pixel rendering, so the use of sub-pixel rendering is still warranted.

Figure 10:
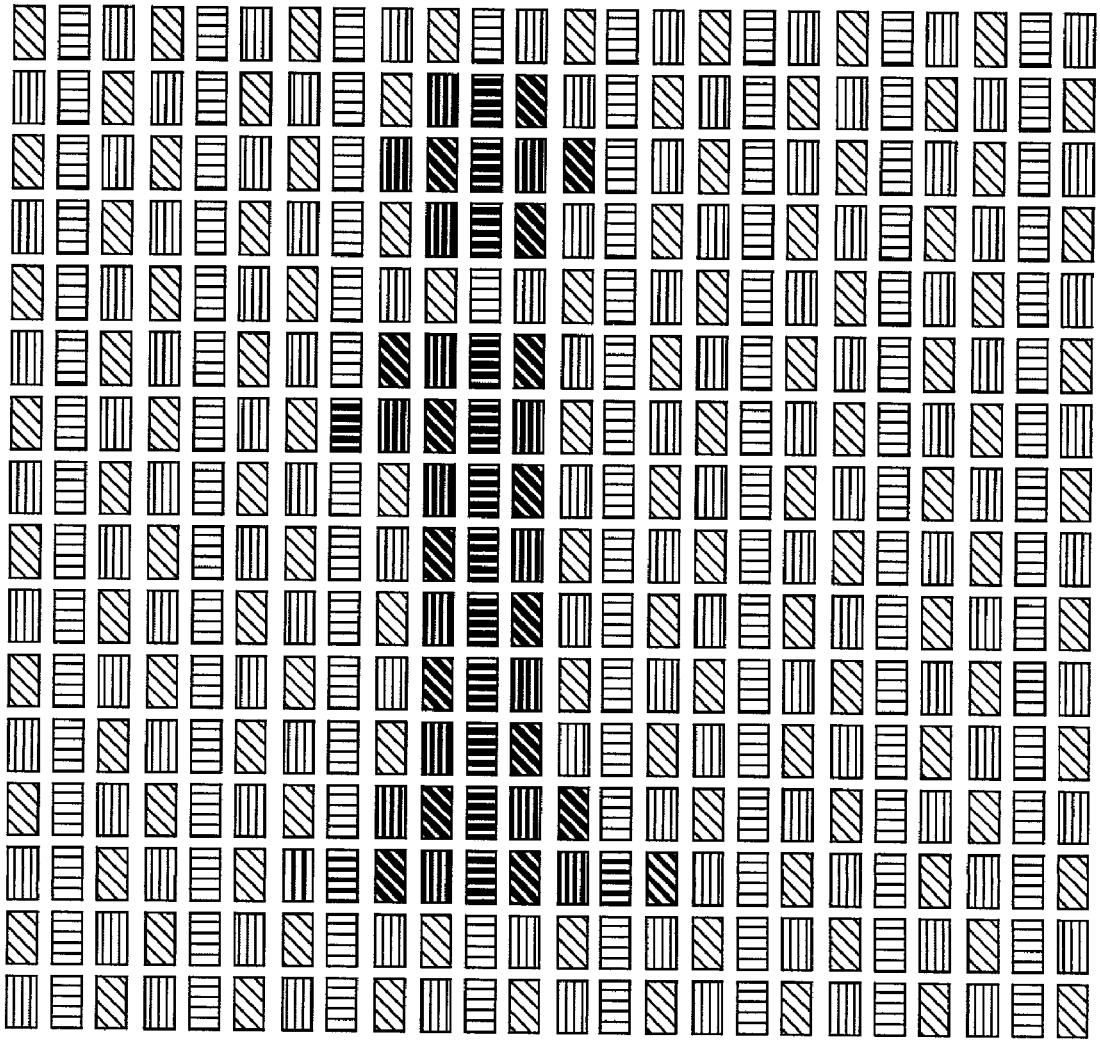
FIG. 10 is an illustration of sub-pixel rendering of a text character on a PENTILE™ 1 display.
Figure 11:
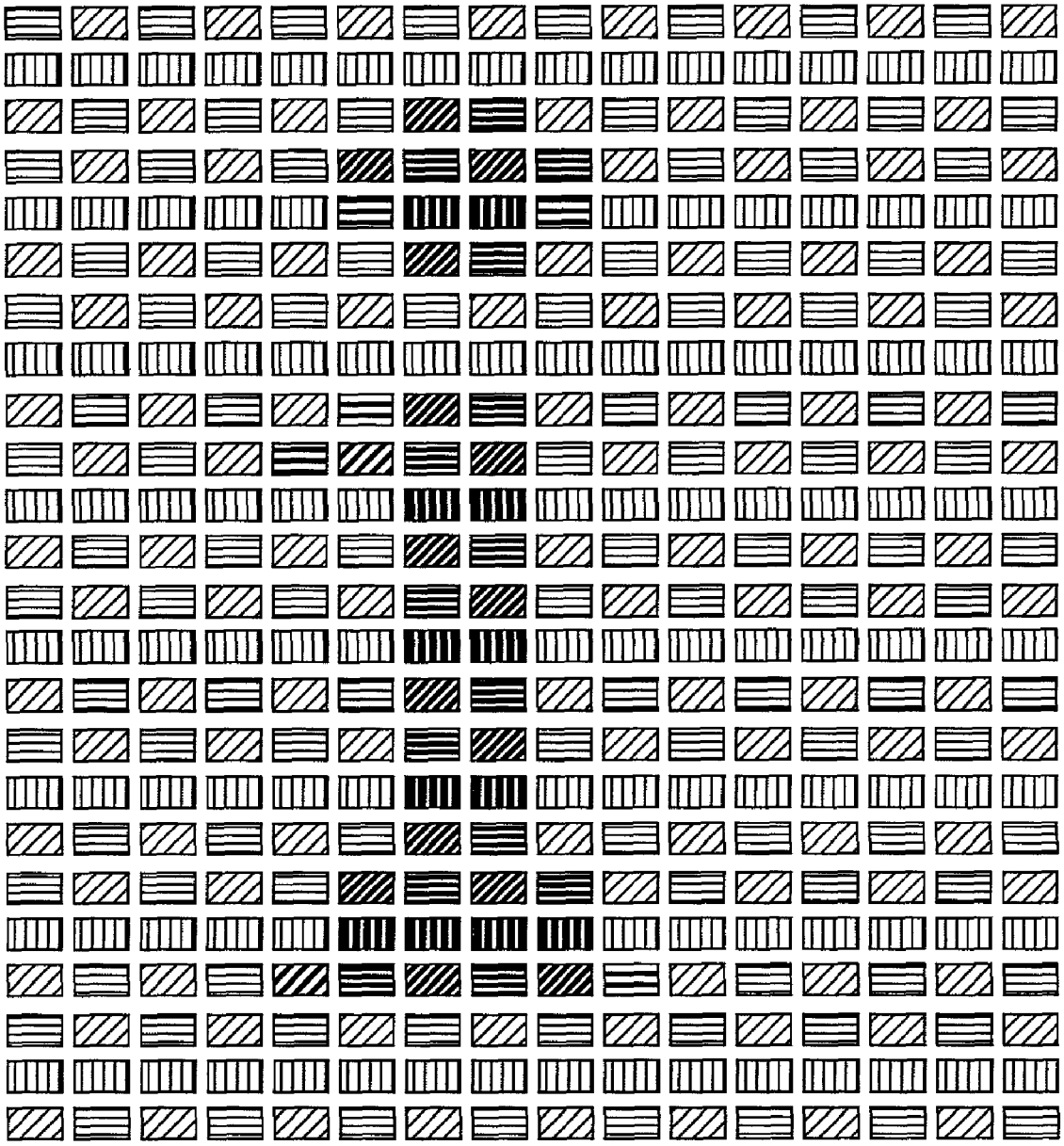
FIG. 11 is an illustration of the results of rotating the image of FIG. 10 using the present invention.
Figure 12A:
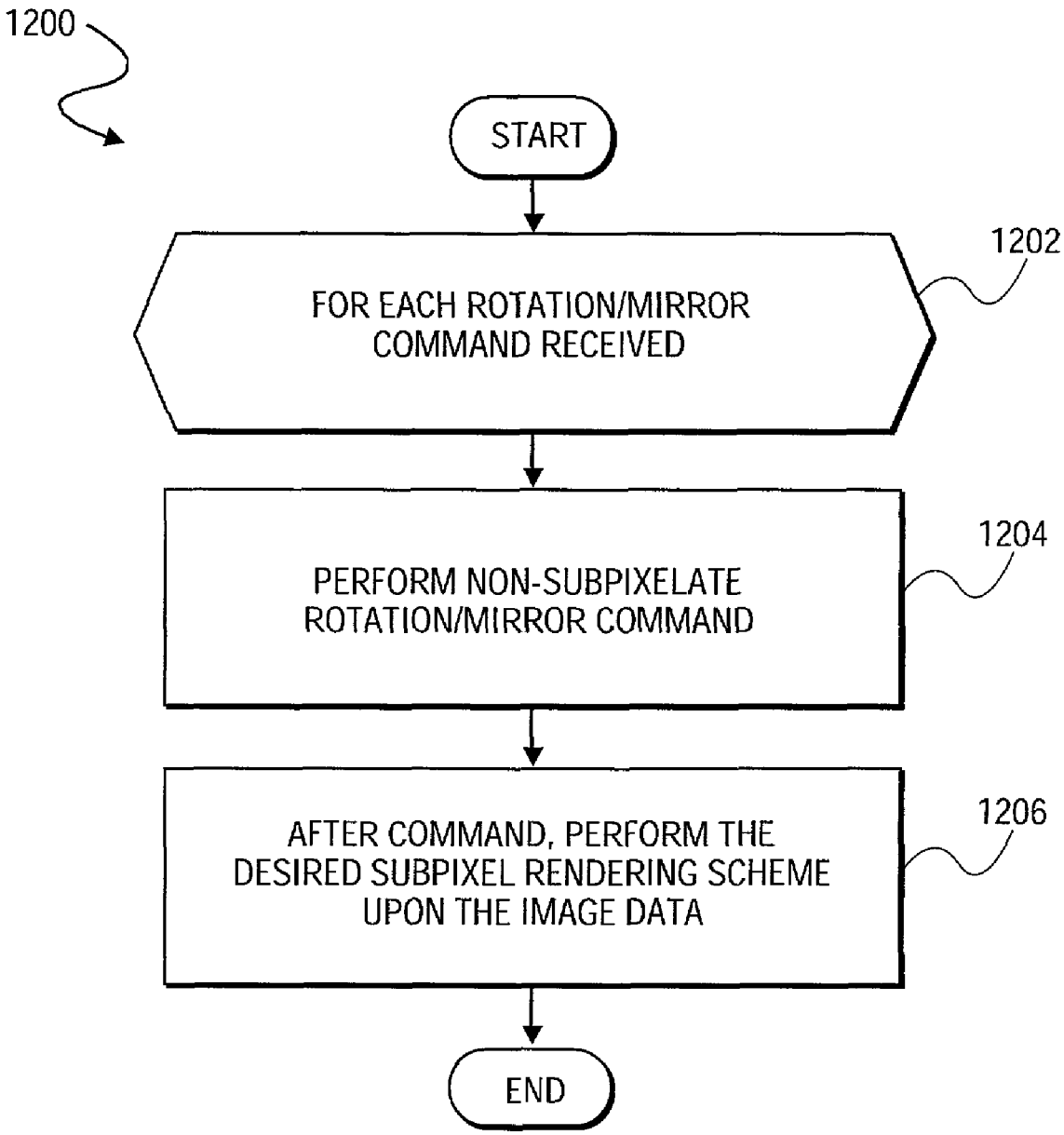
FIG. 12A is another embodiment of the methods as practiced in accordance with the present invention.
Figure 12B:
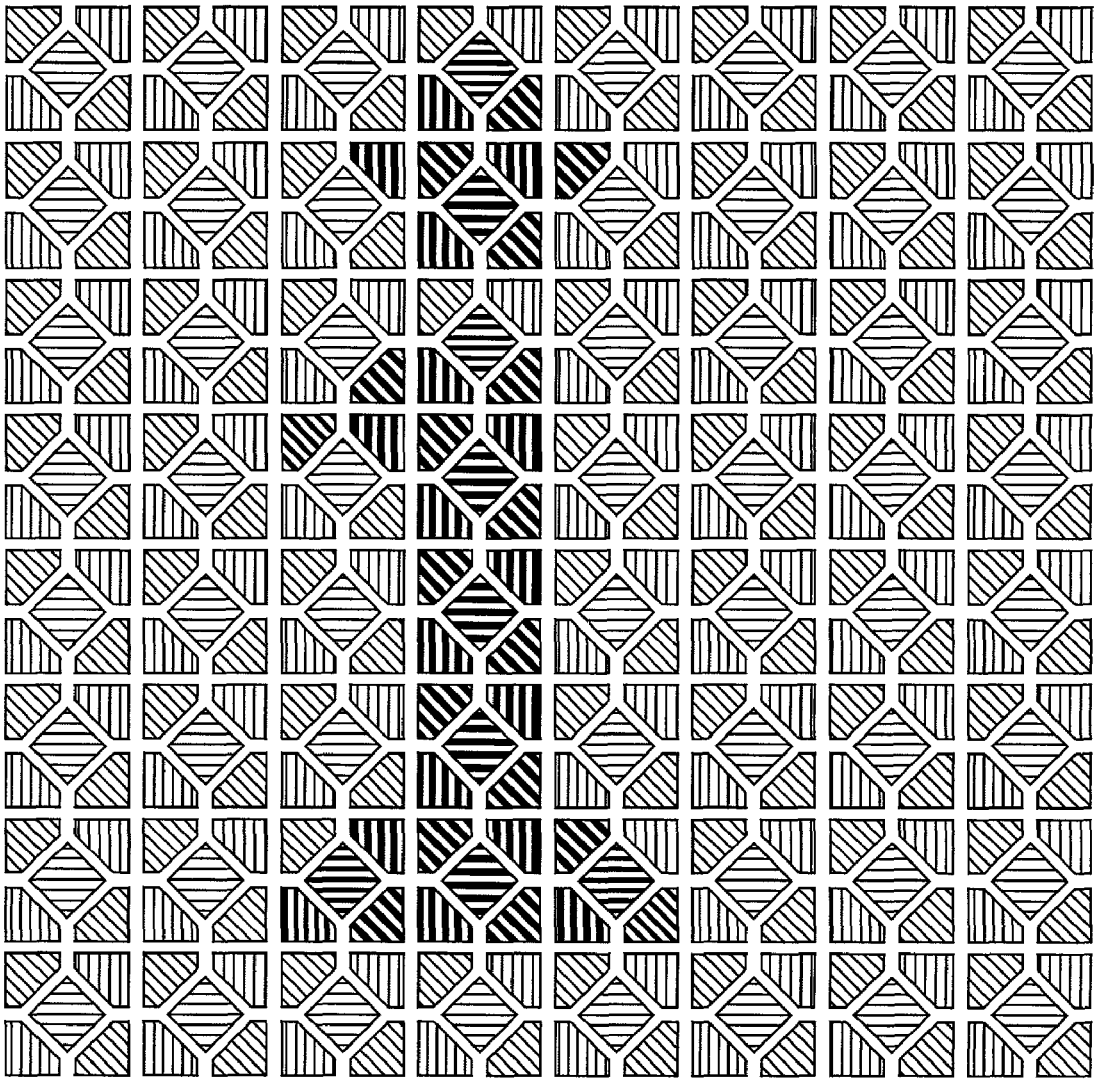
FIG. 12B is an illustration of sub-pixel rendering of a text character on PENTILE™ 2 display.

The sub-pixel rendering Nyquist limit 950 and sub-pixel rendering addressability limit 950 are the same for some PENTILE™ architectures shown in FIGS. 10, 11 and 12B. It is to be noted that it is symmetrical and coincident, due to the nature of the substantially symmetrical layout of the red and green sub-pixels—forming substantially a checkerboard pattern. When compared to the horizontally aligned text relative addressability requirement 930 and vertically aligned text relative addressability requirement 940, note that the rotation orientation of the PENTILE™ sub-pixel rendering Nyquist limit 950 and sub-pixel rendering addressability limit 950 allow for substantially equal image quality in any axis.

Thus, the PENTILE™ sub-pixel architecture is better suited for rotated text or graphics images, at any angle of rotation.

A method of using and rotating images for sub-pixelated panels comprises rotating a high resolution conventional, non-sub-pixel rendered image, using the Badger, or other suitable method, followed by sub-pixel rendering as described in the '612 application, or any other suitable method. By sub-pixel rendering after the rotation, the sub-pixel rendering need not suffer disruption as noted earlier. It will be appreciated that such a suitable sub-pixel rendering algorithm could reside and/or operate in either the graphics system in a computer, before it is transferred to the display by methods, such as analog or digital signal on cable—as is generally known in the art. Alternatively, the rotated high resolution image may be sent to a standalone monitor, in which a display controller may perform the sub-pixel rendering, perhaps in conjunction with scaling methods such as found in the '612 application or other suitable methods.

FIGS. 10 and 11 show the text character "i", sub-pixel rendered, by any suitable method. As shown, this character represents black text on a white background. It will be noted that the sub-pixels attempt to shape, or reconstruct, an idealized character; but—as described before—due to the limitations of the number of sub-pixels available, it is only an approximation. However, it is readily seen that it is a better approximation than using sub-pixel rendering on the RGB stripe panel. FIG. 11 shows the results of rotating the panel one direction, while rotating the image in the counter direction, before sub-pixel rendering. It should be noted how similar the two images are.

FIG. 12A describes the above embodiment 1200 as practiced in accordance with the present invention. Method 1200 starts at step 1202, wherein the system receives and accepts rotation/mirror commands—either automatically (as with a turn of the monitor) or via user-input. At step 1204, the system performs a non-sub-pixelated rotation/mirror command upon the image data.

Another method, for the PENTILE™ displays is to sub-pixel render first, then rotate the image using a modification of the Badger, or other suitable method, in which PENTILE™ groups are treated as "pixels" for the first, or high level rotation, with the additional step of rotating the data within the PENTILE™ group, again according to the parameters of the Badger, or other suitable method.

For monochrome text and images, the above embodiment should suffice. However, for non-monochromatic, that is to say, multicolor images, the above embodiment may not be sufficient, as rotating the data may introduce red/green color inversion. Of course, shifting may occur for either monochrome or multicolored images alike. Multicolor images may benefit from an additional step of shifting the red and green data by one red/green sub-pixel in the red/green checkerboard, in any orthogonal direction convenient. Such shifting restores the correct red/green color. Additionally, by moving the data in the direction of the blue stripes in one style of PENTILE™ architecture (known as "PENTILE™ 1"—as depicted in FIG. 10) architecture simplifies the calculation of the blue values. The same simplification holds, as does treating the two blue sub-pixels as one reconstruction point, similar to the single blue sub-pixel of another style of the PENTILE™ architecture (known as PENTILE™ 2—as depicted in FIG. 12B), per PENTILE™ group, during sub-pixel rendering.

Figure 13:
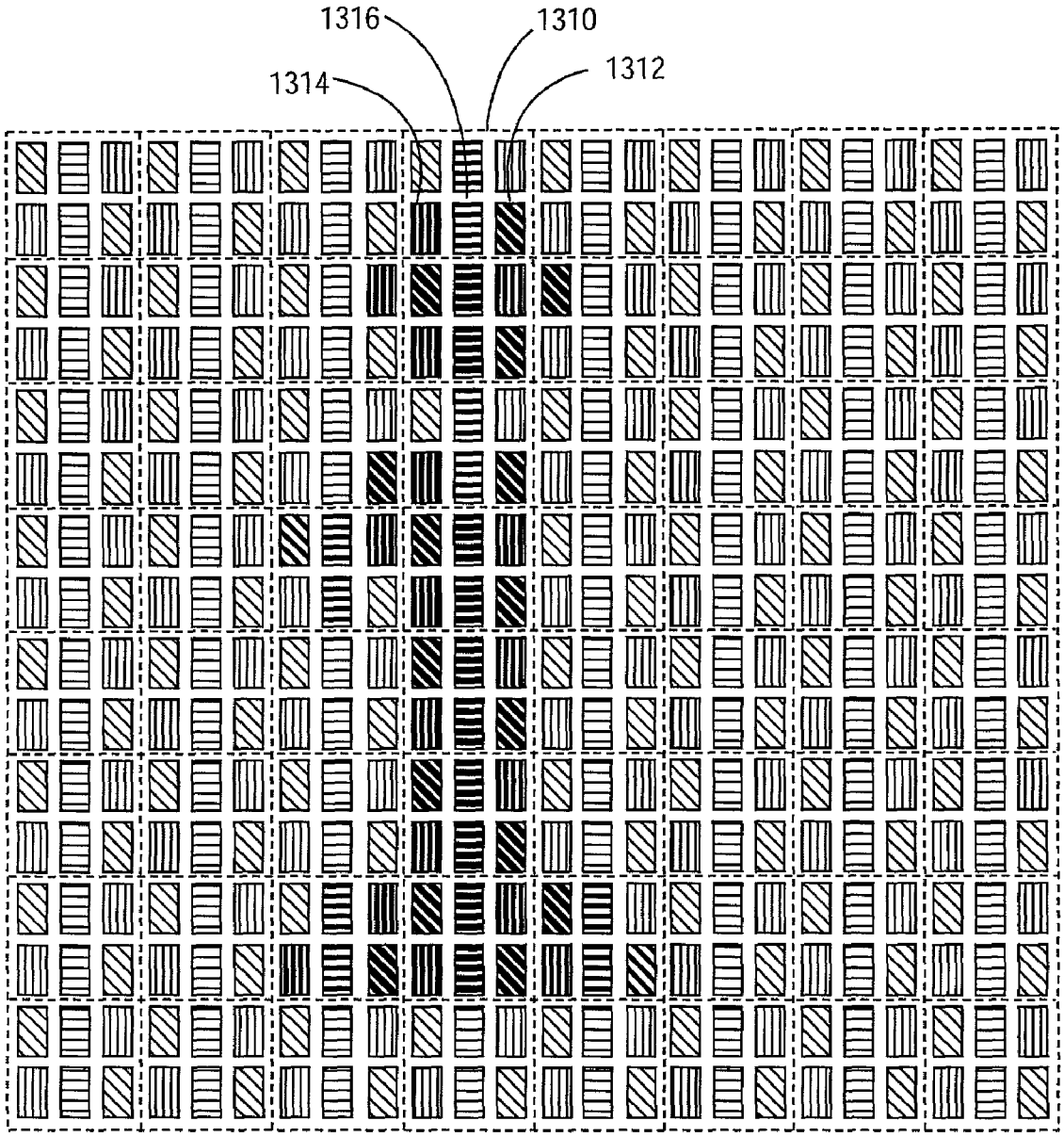
FIG. 13 is an illustration of sub-pixel rendering of a text character on a PENTILE™ 1 display.
Figure 14:
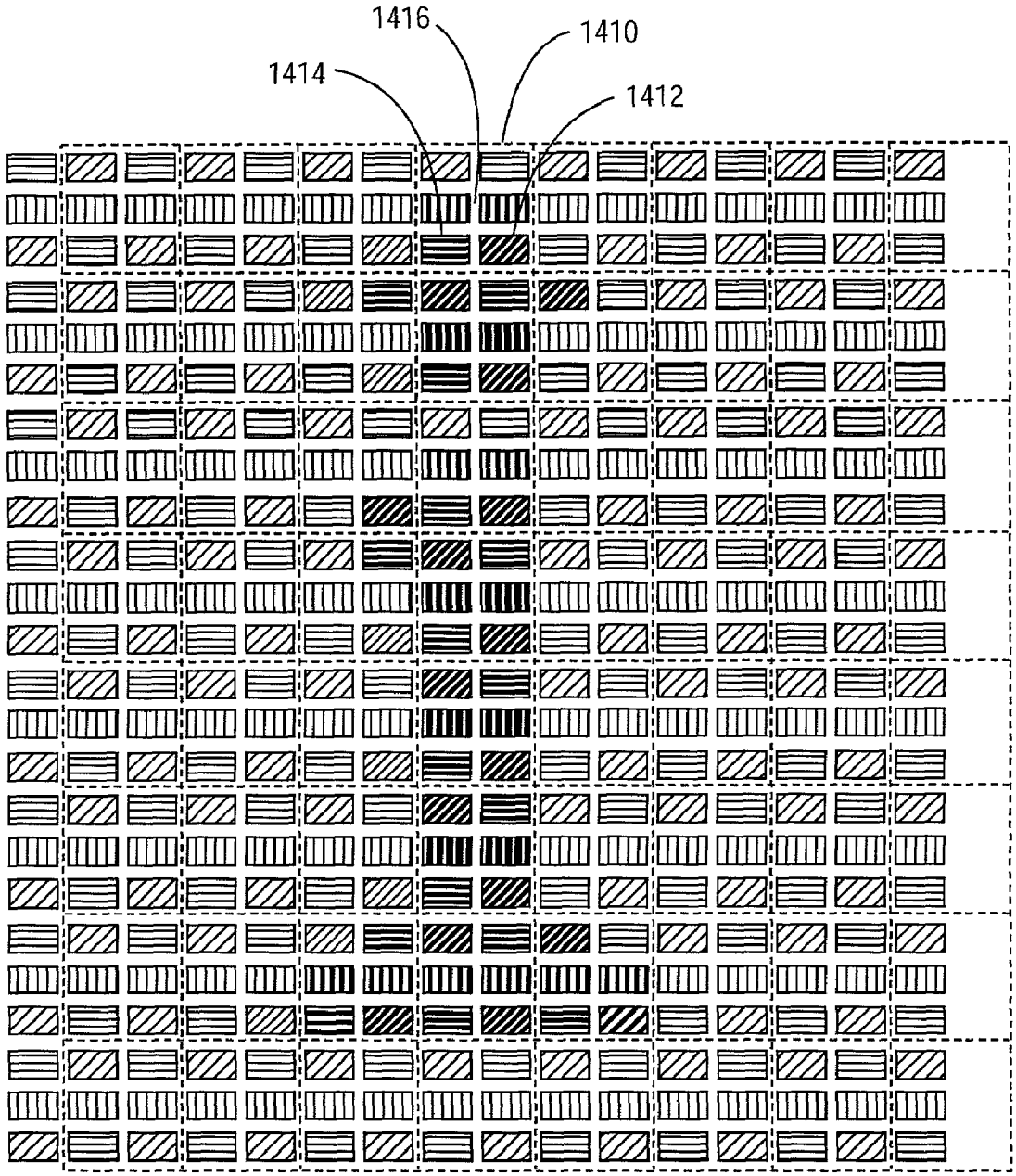
FIG. 14 is an illustration of the results of rotating the image of FIG. 13 using the present invention.

Exploring the above method closer, in FIG. 13, the PENTILE™ group 1310 is rotated and shifted to become the PENTILE™ group 1410 in FIG. 14. It should be noted that in FIG. 13, the green sub-pixel 1314 that is turned off, is remapped to the green sub-pixel 1414 in FIG. 14, while the red sub-pixel 1312 in FIG. 13 is remapped to the red sub-pixel 1412 in FIG. 14. It should also be noted that the blue data value applied to the two vertically and centrally oriented blue sub-pixels 1316 of FIG. 13 are remapped to the two horizontally and centrally oriented blue sub-pixels 1416 in FIG. 14.

Figure 15:
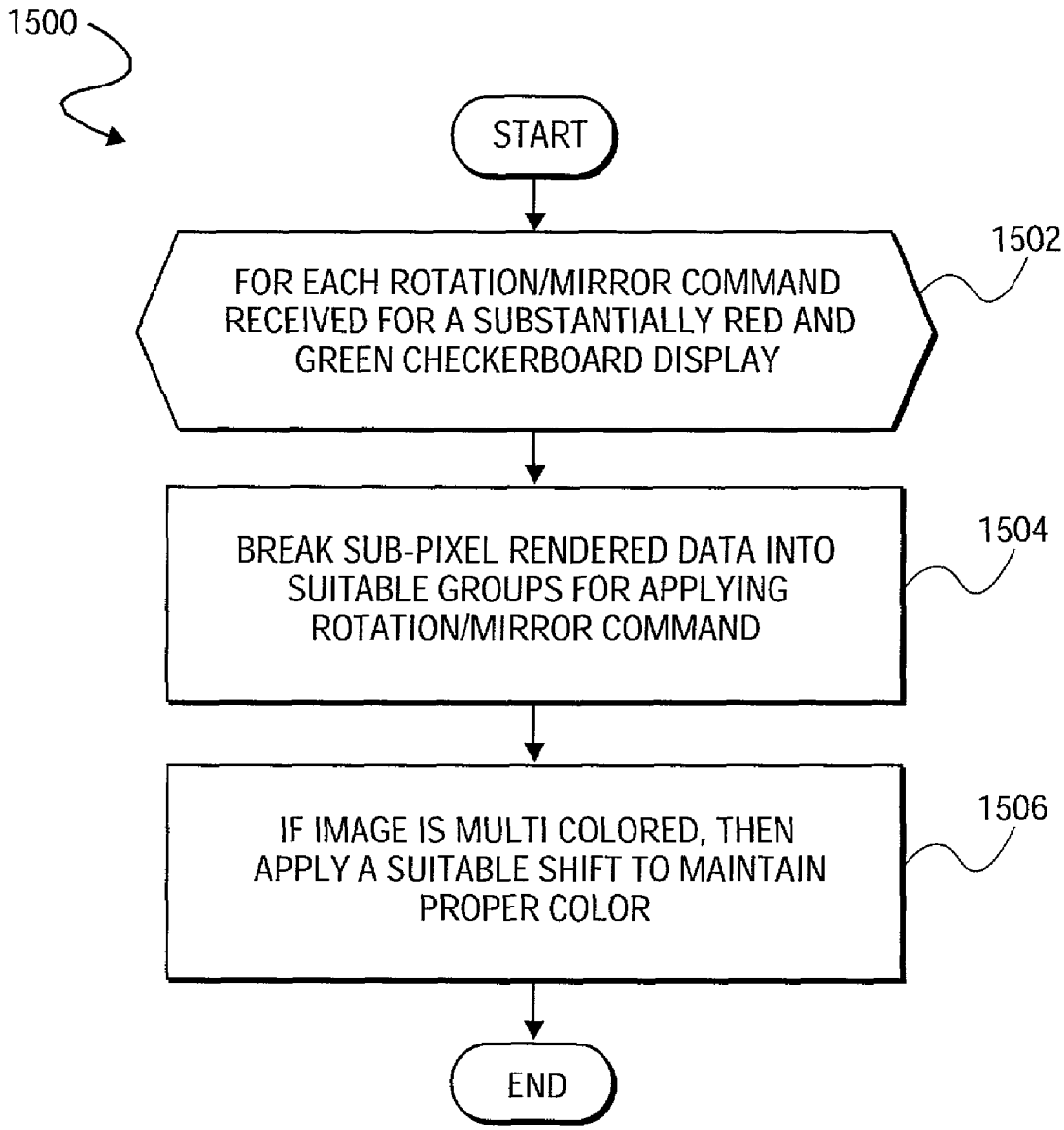
FIG. 15 is yet another embodiment of a method as practiced in accordance with the present invention.

FIG. 15 is yet another embodiment made in accordance with the principles of the present invention. The method 1500 starts at step 1502 wherein rotation/mirror commands are received for a display comprising substantially a red and green checkboard arrangement, such as the family of PENTILE™ architectures. At step 1504, the sub-pixel rendered image data is divided into suitable groups to which the rotation/mirror command (such as may be taught by Badger or some other suitable rotation/mirror scheme) is to be applied. The rotation/mirror command is then applied to these groups. At step 1506, if the image is a multicolor image, then an appropriate shift is applied to maintain the proper color.

Yet another method of rotating an image allows any rotation angle. The original high resolution image is treated as a set of implied sample areas per Elliott et al. in US Published Application Number 2003/0034992 which is incorporated herein by reference. The relative angles and position of the implied sample area and resamples are used to calculate the resample filter coefficients. Alternatively, the same concept of relative rotation resampling may be used with other sub-pixel rendering/scaling resampling algorithms known in the art, such as bilinear, bicubic, etc, or yet to be developed.

This works best on high resolution images in which only a portion of the image is to be shown at a time, such as maps. This method allows scaling, panning, and rotation in a single step. If used on an image that is the same size or smaller than the size of the target display, there will be blank areas that may be filled in with "wallpaper" or other background as desired.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative sense rather than a restrictive sense.

What is claimed is:

1. A computer-readable non-transitory medium storing instructions that cause a machine to perform a method of rotating an image, said image comprising at least one member of a group, said group comprising text and images, the method comprising:

building a data set based on a specified font style and sub-pixel-rendering (SPR) scheme, the specified font style and SPR scheme selected from among a plurality of respective font styles and SPR schemes;

rotating said at least one member of the group in an orientation of a given rotation command to produce a rotated image group;

storing said rotated image group within a system;

applying the data set to said stored image group to produce an updated image storage;

producing a rotated sub-pixel rendered image group from the updated image group by sub-pixel rendering the updated image group; and displaying an image from said updated image storage on a display panel wherein said image is capable of being displayed in one of a plurality of rotation orientations upon said display panel upon receipt of a given rotation command.

2. The computer-readable non-transitory medium as recited in claim 1 wherein said sub-pixel rendering further comprises RGB stripe sub-pixel rendering.

3. The computer-readable non-transitory medium as recited in claim 1 wherein said data set is pre-processed and stored within said system.

4. The computer-readable non-transitory medium as recited in claim 1 wherein said data set is computed in real time upon receipt of the rotation command.

5. The computer-readable non-transitory medium as recited in claim 1 wherein the given rotation command comprises a mirror command.

6. The computer-readable non-transitory medium as recited in claim 1 wherein said display panel comprises one of a group of sub-pixel architectures, said group comprising RGB stripe and Pentile.

7. The computer-readable non-transitory medium as recited in claim 1 wherein said display panel substantially comprises a checkerboard of red and green sub-pixels.

8. The computer-readable non-transitory medium as recited in claim 1 wherein said sub-pixel rendering further comprises a Nyquist limit and an addressability limit and further wherein said Nyquist limit and said addressability limit allow for substantially equal image quality in any axis of rotation.

9. The computer-readable non-transitory medium as recited in claim 1 wherein said display panel substantially comprises groups of red, green and blue sub-pixels repeating in a first orientation relative to a viewer of the display panel;

wherein the given rotation command is responsive to a display rotation command rotating the display such that the groups of red, green and blue sub-pixels repeat in a second orientation relative to the viewer of the display panel; and wherein said rotating and sub-pixel rendering sub-pixel renders said at least one member of the group for image rendering according to the second orientation of the repeating groups of red, green and blue sub-pixels.

10. A computer-readable non-transitory medium storing instructions that cause a machine to perform a method of rotating an image for display on a display panel, said image comprising at least one member of a group, said group comprising text and images, the method comprising:

building a data set based on a given font style and a given sub-pixel-rendering (SPR) scheme, the specified font style and SPR scheme selected from among a plurality of respective font styles and SPR schemes;

producing sub-pixel rendered image data from said at least one member of the group by sub-pixel rendering said at least one member of the group according to the data set;

storing said sub-pixel rendered image data within a system so as to form stored sub-pixel rendered image data;

grouping said stored sub-pixel rendered image data into a plurality of sub-pixel groups;

rotating said plurality of sub-pixel groups such that each of said sub-pixel group is rotated as a pixel on a pixel-to-pixel basis;

after the rotating, copying said sub-pixel rendered image data to produce an updated image storage; and displaying an image from said updated image storage on said display panel wherein said image is capable of being displayed in one of a plurality of rotation degrees upon said display panel upon receipt of a rotation command.

11. The computer-readable non-transitory medium as recited in claim 10 wherein said display panel comprises a Pentile architecture.

12. The computer-readable non-transitory medium as recited in claim 10 wherein said display panel substantially comprises a checkerboard of red and green sub-pixels.

13. A system comprising a processor, an image storage and a display panel capable of displaying an image from said image storage; wherein further said display panel comprises substantially equal sub-pixel rendering addressability limits in horizontal, vertical and diagonal directions, and said image being capable of being displayed in a plurality of rotation degrees upon said display panel upon receipt of a rotation command; said image further comprising at least one member of a group, said group comprising text and images; said system further comprising:

means for building a data set based on a specified font style and sub-pixel-rendering (SPR) scheme, the specified font style and SPR scheme selected from among a plurality of respective font styles and SPR schemes;

means for rotating said at least one member of the group in the orientation of a given rotation command, so as to produce a rotated image group;

means for storing said rotated image group;

means for applying the data set to said stored image group to produce an updated image storage;

means for sub-pixel rendering a rotated image group to produce a rotated sub-pixel rendered image group; and means for displaying said image from said updated image storage on said display panel.

14. A system comprising a processor, an image storage and a display panel capable of displaying an image from said image storage and wherein further said display comprises substantially equal sub-pixel rendering addressability limits in horizontal, vertical and diagonal directions, and said image being capable of being displayed in a plurality of rotation degrees upon said display panel upon receipt of a rotation command; said image further comprising at least one member of a group comprising text and images; said system further comprising:

means for building a data set based on a specified font style and sub-pixel-rendering (SPR) scheme, the specified font style and SPR scheme selected from among a plurality of respective font styles and SPR schemes;

means for sub-pixel rendering said at least one member of the group according to the data set, so as to produce sub-pixel rendered data;

means for grouping said sub-pixel rendered data into a plurality of sub-pixel groups;

means for rotating said plurality of sub-pixel groups such that each said sub-pixel group is rotated and stored within said image storage as a pixel on a pixel-to-pixel basis; and means for copying the rotated sub-pixel groups stored within said image storage to produce an updated image storage; and means for displaying an image from said updated image storage on said display panel.

* * * * *